US009541943B2

(12) United States Patent
Tokuda et al.

(10) Patent No.: US 9,541,943 B2
(45) Date of Patent: Jan. 10, 2017

(54) OPERATION LEVER AND GRIP

(71) Applicant: KUBOTA CORPORATION, Osaka (JP)

(72) Inventors: Takayuki Tokuda, Osaka (JP); Masahiro Yamamoto, Osaka (JP); Teruo Kunizawa, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 20 days.

(21) Appl. No.: 14/335,085

(22) Filed: Jul. 18, 2014

(65) Prior Publication Data

US 2015/0020635 A1 Jan. 22, 2015

(30) Foreign Application Priority Data

Jul. 22, 2013 (JP) ..... 2013-151960
Jul. 22, 2013 (JP) ..... 2013-151961
(Continued)

(51) Int. Cl.
*G05G 1/06* (2006.01)
*G05G 9/047* (2006.01)
(Continued)

(52) U.S. Cl.
CPC ..... *G05G 1/06* (2013.01); *E02F 3/964* (2013.01); *E02F 9/2004* (2013.01); *G05G 9/047* (2013.01);
(Continued)

(58) Field of Classification Search
CPC G05G 1/06; G05G 9/047; G05G 2009/04781; G05G 2009/04774; G05G 1/04; E02F 3/964; E02F 9/2004; Y10T 74/20268; Y10T 74/20612
See application file for complete search history.

(56) References Cited

U.S. PATENT DOCUMENTS 5,768,947 A * 6/1998 Fee ..... E02F 9/2004 74/491
6,580,418 B1 * 6/2003 Grome ..... G05G 9/047 345/161
(Continued)

FOREIGN PATENT DOCUMENTS

JP 63-121933 8/1988
JP 63-130813 8/1988
(Continued)

OTHER PUBLICATIONS

Japanese Office Action issued in JP 2013-151962 and mailed on Jun. 21, 2016.
(Continued)

*Primary Examiner* — Adam D Rogers
(74) *Attorney, Agent, or Firm* — Greenblum & Bernstein, P.L.C.

(57) ABSTRACT

Provided is an operation lever adapted to make a blade perform an action other than an up and down action by rotatably a grip around the shaft center of a lever shaft. The operation lever has a lever shaft operable back and forth, corresponding to an up and down action of a blade of a dozer unit, and a grip provided on an upper part of the lever shaft and capable of rotating in a clockwise direction and counterclockwise direction from a neutral position around a shaft center of the lever shaft by a predetermined rotation angle, corresponding to an angle action or a tilting action of the blade. The grip includes a return-to-neutral spring adapted to return the grip from a rotated position to a neutral position, and the rotation angle of the grip in the clockwise direction is set to be different from that in the counterclockwise direction.

10 Claims, 30 Drawing Sheets

(30) Foreign Application Priority Data

Jul. 22, 2013 (JP) ..... 2013-151962
Jul. 22, 2013 (JP) ..... 2013-151963
Jul. 22, 2013 (JP) ..... 2013-151964

(51) Int. Cl.
*E02F 3/96* (2006.01)
*E02F 9/20* (2006.01)

(52) U.S. Cl.
CPC ..... *G05G 2009/04774* (2013.01); *G05G 2009/04781* (2013.01); *Y10T 74/20268* (2015.01); *Y10T 74/20612* (2015.01)

(56) References Cited

U.S. PATENT DOCUMENTS

| | | | | |
|---|---|---|---|---|
| 6,655,229 | B2 | 12/2003 | Yamamoto | |
| 6,988,295 | B2 * | 1/2006 | Tillim | A61B 17/2909 16/110.1 |
| 7,546,783 | B2 * | 6/2009 | Tucker | F16H 59/0278 74/543 |
| 7,635,045 | B2 * | 12/2009 | Shearer | E02F 9/2004 180/315 |
| 8,924,098 | B2 * | 12/2014 | Zhdanov | E02F 3/7613 701/50 |
| 9,058,051 | B2 * | 6/2015 | Miura | G05G 1/06 |

FOREIGN PATENT DOCUMENTS

| | | |
|---|---|---|
| JP | 1-142021 | 9/1989 |
| JP | 5-189073 | 7/1993 |
| JP | 8-268100 | 10/1996 |
| JP | 11-78572 | 3/1999 |
| JP | 11-181815 | 7/1999 |
| JP | 2000-047745 | 2/2000 |
| JP | 2001-262625 | 9/2001 |
| JP | 2005-4315 | 1/2005 |
| JP | 2005-120821 | 5/2005 |
| JP | 2009-052285 | 3/2009 |
| JP | 2010-211695 | 9/2010 |
| JP | 2011-053789 | 3/2011 |
| JP | 2012-127150 | 7/2012 |

OTHER PUBLICATIONS

Japanese Office Action issued in JP 2013-151964 and mailed on Jun. 21, 2016.
Japanese Office Action (with machine translation) issued in JP 2013-151963 and mailed on Aug. 8, 2016.
Japanese Office Action (with machine translation) issued in JP 2013-151961 and mailed on Aug. 31, 2016.

* cited by examiner

OPERATION LEVER AND GRIP

TECHNICAL FIELD

The present invention relates to an operation lever adapted to operate a dozer unit or the like equipped for a construction machine (earth-moving machine) such as a backhoe, and to a grip constituting a grip operation part.

BACKGROUND ART

There has been a construction machine that includes a dozer unit and is adapted to operate the blade of the dozer unit with an operation lever. The operation lever of the construction machine has a lever shaft and a grip provided on the upper part of the lever shaft. Construction machines having an operation lever are disclosed in Japanese Unexamined Patent Publications, JP-A-2009-52285 and JP-A-2011-53789.

JP-A-2009-52285 discloses that the blade performs an up and down action by performing a swing operation of the operation lever back and forth, whereas the blade performs a tilting action by operating an operation switch provided on the grip. Also, JP-A-2009-52285 discloses that by operating a pedal provided on the front side of an operator seat, the blade performs an angle action.

In the operation lever described in JP-A-2011-53789, the grip has a grip main body attached to the lever shaft and an operation switch provided on the upper part of the grip main body. JP-A-2011-53789 discloses that the blade performs an up and down action by performing a swing operation of the operation lever back and forth, whereas the blade performs an angle action by operating the operation switch provided on the grip. On the upper part of the lever shaft, the grip main body is attached, and is not configured to rotate around the shaft center of the lever shaft.

Further, each of JP-A-2011-53789 and JP-A-2005-120821 discloses a grip including: a grip main body gripped by the palm and finger; and a switch that is arranged at the top of the grip main body and operable with the thumb. The grip main body has: a thenar eminence reception surface brought into contact with the thenar eminence; a palm reception surface brought into contact with the middle part of the palm and the hypothenar eminence; a finger reception surface brought into contact with the fingers; and an open surface that is located between the tips of the fingers and the thenar eminence and can be arranged with the thumb when the grip main body is gripped by the hand.

SUMMARY OF INVENTION

Technical Problem

There has been no operation lever adapted to activate the blade of a dozer unit by rotating a grip of the operation lever around the shaft center of a lever shaft by a predetermined angle.

Consider rotating the grip around the shaft center of the lever shaft by the predetermined angle to thereby operate the blade of the dozer unit. In this case, there may be employed a structure to fit a grip core member at the outside of the upper part of the lever shaft, and to make the grip core member support a grip main body rotationally operably around the shaft center of the lever shaft by the predetermined angle.

In such a rotational operation type operation lever adapted to rotate the grip, a round shaft may be used as the lever shaft, and an outer fit part of the grip core member fitted at the outside of the round shaft may be formed in a cylindrical shape. In this case, locking (rotation-prevention) in a rotational direction of the grip is required so as to prevent relative rotation between the lever shaft and the grip core member.

Possible structures for the locking in the rotational direction include a structure to, in the state where the outer fit part of the grip core member is fitted at the outside of the lever shaft, insert a pin from the grip core member to the lever shaft to perform the locking in the rotational direction.

On the other hand, it is necessary to provide a rotation detection sensor adapted to detect the rotation of the grip main body inside the grip main body. In this case, for example, in case of failure of the rotation detection sensor, it is necessary to detach the grip from the lever shaft.

As described above, in the structure to insert the pin from the grip core member to the lever shaft to perform the locking in the rotational direction, it is difficult to detach the grip from the lever shaft because the pin is inserted from the grip core member to the lever shaft in an interference fit state. Accordingly, to replace the grip, it is necessary to replace both of the lever shaft and the grip.

Also, to make it possible to easily detach the grip from the lever shaft, it is possible to perform the locking in the rotational direction by driving a screw into the lever shaft through the grip core member. However, such locking gives rise to a problem that repeatedly rotating the grip loosens the screw to cause a backlash.

Further, in the case of activating the blade of the dozer unit by an operation based on rotation of the grip, it may be necessary to, inside the grip main body, provide a rotation detection sensor adapted to detect the rotation of the grip. However, intrusion objects such as water and sand may intrude into the grip main body from an attachment part of an operation switch of the grip main body. As a result, in such a rotational operation type operation lever, the rotation detection sensor is often exposed to the intrusion objects such as water and sand intruding from the attachment part of the operation switch. Long term exposure of the rotation detection sensor to the intrusion objects such as water and sand causes a failure or a reduction in life.

The grip disclosed in each of Japanese Unexamined Patent Publications JP-A-2011-53789 and JP-A-2005-120821 is mainly for performing a swing operation of a manual operation tool, and configured to be unable to perform a turning operation with respect to the manual operation tool. Also, a turn sensor can be provided in the lower part of the grip so as to be able to perform the turning operation with respect to the manual operation tool. However, there occurs a problem that in the case where the turn sensor is exposed, the turn sensor may be affected by rainwater, whereas in the case where the turn sensor is incorporated inside the lower part of the grip, an incorporation part interferes with a hand gripping the grip. Further, the grip disclosed in each of JP-A-2011-53789 and JP-A-2005-120821 has the thenar eminence and finger reception surface, which are smooth and circular, and therefore has the shape not suitable to transmit turning force to the grip main body when the wrist is flexed toward the palmar or dorsal side.

Therefore, in consideration of the problems described above, the present invention intends to provide an operation lever of a grip rotational operating type, which can prevent a rotation detection sensor adapted to detect a rotational operation of a grip from being exposed to intrusion objects such as water and sand intruding into a grip main body. Also, the present invention intends to provide an operation lever that is adapted to make a blade perform an action other than an up and down action by rotationally operating a grip around the shaft center of a lever shaft.

In addition, the present invention intends to provide an operation lever of a grip rotational operating type, which makes it possible to easily replace a grip. Also, the present invention intends to provide an operation lever of a grip rotational operating type, which can prevent a rotation detection sensor adapted to detect a rotational operation of a grip from being exposed to intrusion objects such as water and sand intruding into a grip main body.

Further, the present invention intends to provide a grip adapted to enable a turning operation of a grip main body, a turn sensor to be incorporated inside the lower part of the grip main body, and the turning operation of the grip main body to be detected. Also, the present invention intends to provide a grip adapted to enable a turning operation to be facilitated by pressing by the thenar eminence when flexing the wrist toward the palmar side or by hooking the finger when flexing the wrist toward the dorsal side.

Solution to Problem

Technical configurations taken by the present invention in order to solve the technical problems are characterized by the following points.

An operation lever comprises: a lever shaft operable back and forth, corresponding to an up and down action of a blade of a dozer unit of a construction machine; and a grip provided on an upper part of the lever shaft and being capable of rotating in a clockwise direction and a counter-clockwise direction from a neutral position around a shaft center of the lever shaft by a predetermined rotation angle, corresponding to an angle action or a tilting action of the blade.

The grip includes a return-to-neutral spring adapted to return the grip from a rotated position to a neutral position, and the rotation angle of the grip is set to be different in the clockwise direction from the rotation angle in the counter-clockwise direction.

The blade performs the angle action in accordance with the rotation of the grip.

The grip includes a grip core member and a grip main body, the grip core member is attached to the upper part of the lever shaft, and the grip main body is supported by the grip core member rotatably around the shaft center of the lever shaft.

An operation lever comprises: a lever shaft having a fit part formed in a polygonal bar shape; and a grip provided on an upper part of the lever shaft, the grip including: a grip core member externally fitting to the fit part of the lever shaft, the grip core member including a fit hole having a surface to be contacted with the polygonal fit part of the lever shaft and being screwed to be fixed to the lever shaft in a state where the fit hole of the grip core member externally fits to the fit part of the lever shaft; and a grip main body supported by the grip core member, the grip main body being capable of rotating around a shaft center of the lever shaft by a predetermined angle.

The grip core member is arranged internally in the grip main body, the grip main body includes an attachment opening for being screwed to fix the grip core member to the lever shaft, and the attachment opening is covered with a detachable cover.

The lever shaft is a hexagonal bar, and the fit hole is a hexagonal hole having a cross-sectional shape corresponding to a cross-sectional shape of the lever shaft.

The grip core member includes: a spring containing part adapted to contain a return-to-neutral spring to return the grip main body to a neutral position from a position to which the grip main body is rotationally operated; and a sensor attachment part to which a rotation detection sensor adapted to detect a rotation of the grip main body is attached.

An operation lever comprises: a lever shaft; and a grip provided on an upper part of the lever shaft, the grip including: an opening formed in a hollow shape in a bottom part; and a grip main body being capable of rotating around a shaft center of the lever shaft by a predetermined angle, the grip main body including: an operation switch provided in an upper part of the grip main body; a rotation detection sensor provided inside the grip main body and adapted to detect a rotation of the grip main body; and an intrusion object discharge path adapted to discharge the intrusion object from an opening of the bottom part of the grip main body while bypassing the rotation detection sensor, the intrusion object intruding from an attachment part of the operation switch into the grip main body.

The grip is formed so as to be tilted forward, and includes a grip core member externally fitted to be fixed to the upper part of the lever shaft, the grip core member rotatably supporting the grip main body, the grip main body includes a supported wall rotatably supported by an upper part of the grip core member, the supported wall is provided inside the grip main body and on a lower side of the operation switch, and the intrusion object discharge path includes: a discharge guide adapted to guide the intrusion object intruding from the attachment part of the operation switch to an upper front side of the supported wall; a passage path formed on a front side of the supported wall to pass the intrusion object guided along the discharge guide to a lower side of the supported wall; and a directing surface formed by an inner surface of a front side wall part of the grip main body to guide the intrusion object passed through the passage path to an opening side of the bottom part of the grip main body.

The grip main body includes a supporting wall provided in a lower part inside the grip main body, the supporting wall is rotatably supported by the grip core member, and the intrusion object discharge path includes another passage path formed on a front side of the supporting wall, the another passage path guiding and passing the intrusion object through the supporting wall such that the intrusion object is guided to the opening of the bottom part of the grip main body along the directing surface.

The operation lever comprises: a selector switch provided in the upper part of the grip main body, the selector switch being different from the operation switch. The intrusion object discharge path includes a guide surface adapted to guide the intrusion object to the passage path formed in the supported wall, the intrusion object intruding from an attachment part of the selector switch into the grip main body.

A grip comprises: a grip main body adapted to be gripped by a palm and a finger, the grip main body including: a thenar eminence reception surface adapted to contact with a thenar eminence; a palm reception surface adapted to contact with a middle part of the palm and a hypothenar eminence; a finger reception surface adapted to contact with the finger; an open surface adapted to be located between tips of the finger and the thenar eminence; and a tubular part incorporating a turn sensor adapted to detect a turn of the grip main body.

The grip main body is adapted to include a tilted surface connecting an outer circumferential surface of the tubular part in the lower part, lower parts of the thenar eminence reception surface, the palm reception surface, the finger reception surface, and the open surface to each other, and a thenar tilted surface formed on a lower side of the thenar eminence reception surface is formed so as to have a smaller tilt angle than a tilt angle of a front tilted surface on a lower side of the finger reception surface.

The grip main body has: the front tilted surface formed on the lower side of the finger reception surface; and a palmar tilted surface formed on a lower side of the palm reception surface, and is adapted such that vertical width is formed so as to gradually increase from the front tilted surface to the thenar tilted surface via the palmar tilted surface.

The grip main body includes a palmar flexion pressed part arranged between the thenar eminence reception surface and the palm reception surface, the palmar flexion pressed part being adapted to transmit a turning force to the grip main body by pressing with the thenar eminence.

The grip main body includes a palmar flexion pressed part arranged between the thenar eminence reception surface and the palm reception surface, the palmar flexion pressed part being adapted to transmit a turning force to the grip main body by pressing with the thenar eminence, and the palmar flexion pressed part is elongated from the thenar eminence reception surface to the thenar tilted surface.

The grip main body includes, on the finger reception surface, a dorsiflexion hooking part adapted to transmit turning force to the grip main body by hooking the finger.

A grip comprises: a grip main body gripped by a palm and a finger, the grip main body including: a thenar eminence reception surface adapted to contact with a thenar eminence; a palm reception surface adapted to contact with a middle part of the palm and a hypothenar eminence; a finger reception surface adapted to contact with the finger; an open surface adapted to being located between tips of the finger and the thenar eminence; a palmar flexion pressed part arranged between the thenar eminence reception surface and the palm reception surface, the palmar flexion pressed part adapted to transmit turning force to the grip main body by being pressed with the thenar eminence; and a dorsiflexion hooking part adapted to transmit turning force to the grip main body by being hooked with the finger, the dorsiflexion hooking part being formed on the finger reception surface.

The grip main body includes: a switch arranged at a top of the grip main body; a thumb guiding part formed in an upper part of the thenar eminence reception surface; and a raised part formed between the thumb guiding part and the palm reception surface, the thumb guiding part is formed in a shallow groove shape along which a ball of the thumb is laid and is formed vertically toward the switch, the raised part is adapted to interfere with the hand from reaching the switch and vertically formed along the thumb guiding part, and the raised part and the palmar flexion pressed part are connected to each other.

The grip main body includes: a push button provided in an upper part of the finger reception surface; and a protection structure part rising around the push button in the upper part of the finger reception surface, the push button is adapted to be operated with an index finger or a middle finger, and the lower part of the protection structure part and the upper part of the dorsiflexion hooking part are connected to each other.

The grip main body includes a turn sensor provided in a lower part of the grip main body and adapted to detect a turn of the grip main body.

Advantageous Effects of Invention

According to the present invention, the following effects are produced.

The blade can be made to perform the angle or tilting action by the rotational operation of the grip around the shaft center of the lever shaft. Also, the blade can be made to perform the up and down action and other blade actions by operations with the grip firmly gripped by the five fingers, and operability is high.

Also, the rotational operation angle of the grip is set to an angle that is different between the counterclockwise and clockwise directions, and for example, by setting a rotational operation angle at the time when the wrist is flexed toward the palmar side to rotationally operate the grip main body smaller than a rotational operation angle at the time when the wrist is flexed toward the dorsal side to rotationally operate the grip main body, a load on the wrist of an operator can be reduced.

Further, the blade is made to perform the angle action by the rotational operation of the grip. Accordingly, a direction of the rotational operation of the grip and a direction of the angle action of the blade can be made coincident with each other, and therefore the operability can be improved.

Still further, the grip core member is attached to the upper part of the lever shaft so as to prevent the grip core member from relatively rotating around the shaft center of the lever shaft. Also, the grip core member is made to support the grip main body rotationally operably around the shaft center of the lever shaft. For these reasons, the operation lever is capable of making the blade perform an action other than the up and down action by rotationally operating the grip.

In addition, the fit part of the lever shaft fitted with the grip core member at the outside is formed in the polygonal bar shape. Also, the fit hole fitted at the outside of the fit part of the lever shaft in the surface contact manner is formed in the grip core member to prevent rotation in a direction of the rotational operation of the grip. For these reasons, even in the case of fixing the grip core member to the lever shaft with screws, the screws are not loosened by the rotational operation. Further, the grip can be easily replaced in case of grip failure. That is, the operation lever of a grip rotational operating type can facilitate the grip replacement.

Also, the grip core member can be fixed to the lever shaft with the screws through the attachment opening formed in the grip main body. For this reason, in the state where the grip main body is assembled on the grip core member, the grip can be attached to/detached from the lever shaft. In addition, the screws can be hidden by the cover.

Further, by using the hexagonal bar easily available at low cost as the lever shaft, the operation lever can be provided at low cost.

The grip core member includes: the spring containing part adapted to contain the return-to-neutral spring adapted to return the grip main body to the neutral position from the position to which the grip main body is rotationally operated; and the sensor attachment part adapted to be attached with the rotation detection sensor adapted to detect the rotational operation of the grip main body. Accordingly, assembling workability can be improved.

Also, the intrusion objects such as water and sand intruding into the grip main body from the attachment part of the operation switch are guided to the opening of the bottom part of the grip main body through the intrusion object discharge path while bypassing the rotation detection sensor, and discharged from the opening of the bottom part of the grip main body. In doing so, the rotation detection sensor adapted to detect the rotational operation of the grip main body can be prevented from being exposed to the intrusion objects such as water and sand intruding into the grip main body, and therefore a failure of or a reduction in life of the rotation detection sensor can be prevented.

The intrusion objects such as water and sand intruding from the attachment part of the operation switch are guided by the discharge guide to the upper front end side of the supported wall. Also, the intrusion objects such as water and sand pass through the passage path formed on the front end side of the supported wall to move to the directing surface, and move to the opening side of the bottom wall of the grip main body along the directing surface. In doing so, the intrusion objects such as sand can be made less likely to deposit on the supported wall rotatably supported by the grip core member, and abrasion facilitated by the intrusion objects such as sand into a contact part between the relatively rotating grip main body and grip core member can be reduced.

Also, the grip is provided so as to be tilted forward (extended upward and forward from the bottom), and therefore the inner surface of the front side wall part of the grip main body can be utilized as the directing surface adapted to guide the intrusion objects such as water and sand to the opening side of the bottom part of the grip main body.

Further, the intrusion objects such as water and sand moving downward along the directing surface pass through another passage path formed on the front end side of the supporting wall to move downward to the opening of the bottom part of the grip main body. For this reason, the intrusion objects such as sand can be made less likely to deposit on the supporting wall rotatably supported by the grip core member, and abrasion facilitated by the intrusion objects such as sand into a contact part between the relatively rotating grip main body and grip core member can be reduced.

The intrusion object discharge path has the guide surface adapted to guide the intrusion objects such as water and sand intruding into the grip main body from the attachment part of the selector switch provided in the upper part of the grip main body to the passage path formed on the front end side of the supporting wall. For this reason, the intrusion objects such as water and sand intruding into the grip main body from the attachment part of the selector switch are guided to the front end side of the supported wall along the guide surface. Further, the intrusion objects such as water and sand move to the directing surface through the passage path formed on the front end side of the supported wall, and further move to the opening side of the bottom part of the grip main body along the directing surface. Accordingly, the intrusion objects such as water and sand intruding into the grip main body from the attachment part of the selector switch can be discharged from the opening of the bottom part of the grip main body while bypassing the rotation detection sensor.

According to the present invention, the turning operation of the grip main body is possible, and the turn sensor can be incorporated in the lower part of the grip main body to detect the turning operation of the grip main body.

Also, the grip main body is fitted turnably with respect to the manual operation tool, and in the lower part of the grip main body, has the large-diameter enlarged tubular part incorporating the turn sensor adapted to detect a turn with respect to the manual operation tool. As a result, the turning operation can be performed by flexing the wrist toward the palmar or dorsal side. In addition, the turn sensor can be compactly incorporated in the enlarged tubular part and thereby protected. The turn sensor can detect the turning operation with respect to the manual operation tool.

Further, in the grip main body, the outer circumferential surface of the enlarged tubular part in the lower part, and the lower parts of the thenar eminence reception surface, the palm reception surface, the finger reception surface, and the open surface are connected to each other through the tilted surface. Also, the thenar tilted surface on the lower side of the thermal eminence reception surface is formed so as to have a gentler angle (smaller tilt angle) than a tilt angle of the front tilted surface on the lower side of the finger reception surface. Accordingly, in the case of swinging the manual operation tool back and forth, it is only necessary to bring the hand into contact with the thenar tilted surface having the gentler and smaller tilt angle on the lower side of the thenar eminence reception surface. As a result, a strange feeling in the hand arising when bringing the hand into contact with the thenar tilted surface can be reduced.

In addition, the vertical width is formed so as to gradually increase from the front tilted surface on the lower side of the finger reception surface to the thenar tilted surface on the lower side of the thenar eminence reception surface via the palmar tilted surface on the lower side of the palm reception surface. As a result, the strange feeling in the hand arising when bringing the hand into contact can be reduced.

Also, between the thenar eminence reception surface and the palm reception surface, the grip main body has the palmar flexion pressed part adapted to be pressed by the thenar eminence to transmit turning force to the grip main body when the wrist is flexed toward the palmar side. Accordingly, pressing the palmar flexion pressed part by the thenar eminence when flexing the wrist toward the palmar side can turn the grip main body.

Further, the palmar flexion pressed part is extended from the thenar eminence reception surface to the thenar tilted surface on the lower side of the thenar eminence reception surface, and therefore the turning operation of the grip main body can be performed over a wide range near the wrist.

Still further, the finger reception surface of the grip main body is formed with the dorsiflexion hooking part adapted to hook the finger to transmit turning force to the grip main body when the wrist is flexed toward the dorsal side. For this reason, the turning operation of the grip main body can be easily performed with the finger.

Also, the grip main body has the palmar flexion pressed part arranged between the thenar eminence reception surface and the palm reception surface. The palmar flexion pressed part is adapted to be pressed by the thenar eminence to transmit turning force to the grip main body when the wrist is flexed to the palmar side. The grip main body has the dorsiflexion hooking part adapted to hook the finger to transmit turning force to the grip main body when the wrist is flexed toward the dorsal side. The dorsiflexion hooking part is formed on the finger reception surface. For these reasons, when flexing the wrist toward the palmar side, the palmar flexion pressed part can be pressed by the thenar eminence to turn the grip main body, whereas when flexing the wrist toward the dorsal side, the dorsiflexion hooking part can hook the finger to turn the grip main body, and therefore the turning operation of the grip main body can be easily performed.

In addition, between the thumb guiding part and the palm reception surface, the raised part adapted to interfere with the hand from reaching the switch is formed. The raised part is vertically formed along the thumb guiding part, and the raised part and the palmar flexion pressed part are connected to each other. As a result, a vertical range of the palmar flexion pressed part pressed by the thenar eminence when flexing the wrist toward the palmar side is increased, and therefore it becomes possible to more reliably and easily turn the grip main body in the palmar flexion state.

On the other hand, the grip main body has the raised protection structure part around the push button in the upper part of the finger reception surface. Also, the lower part of the protection structure part and the upper part of the dorsiflexion hooking part are connected to each other. Accordingly, the dorsiflexion hooking part serves as a guide part for guiding the finger to the push button, whereas the push button serves as a reference for hooking the finger on the dorsiflexion hooking part. As a result, it becomes possible to more reliably and easily turn the grip main body in the dorsiflexion state.

The grip main body is fitted turnably with respect to the manual operation tool, and in the lower part of the grip main body, the turn sensor adapted to detect a turn with respect to the manual operation tool is provided. Accordingly, the turning operation of the grip main body can be easily and reliably detected.

DESCRIPTION OF EMBODIMENTS

Embodiments of the present invention will hereinafter be described with reference to the drawings.

First Embodiment

Figure 1A:
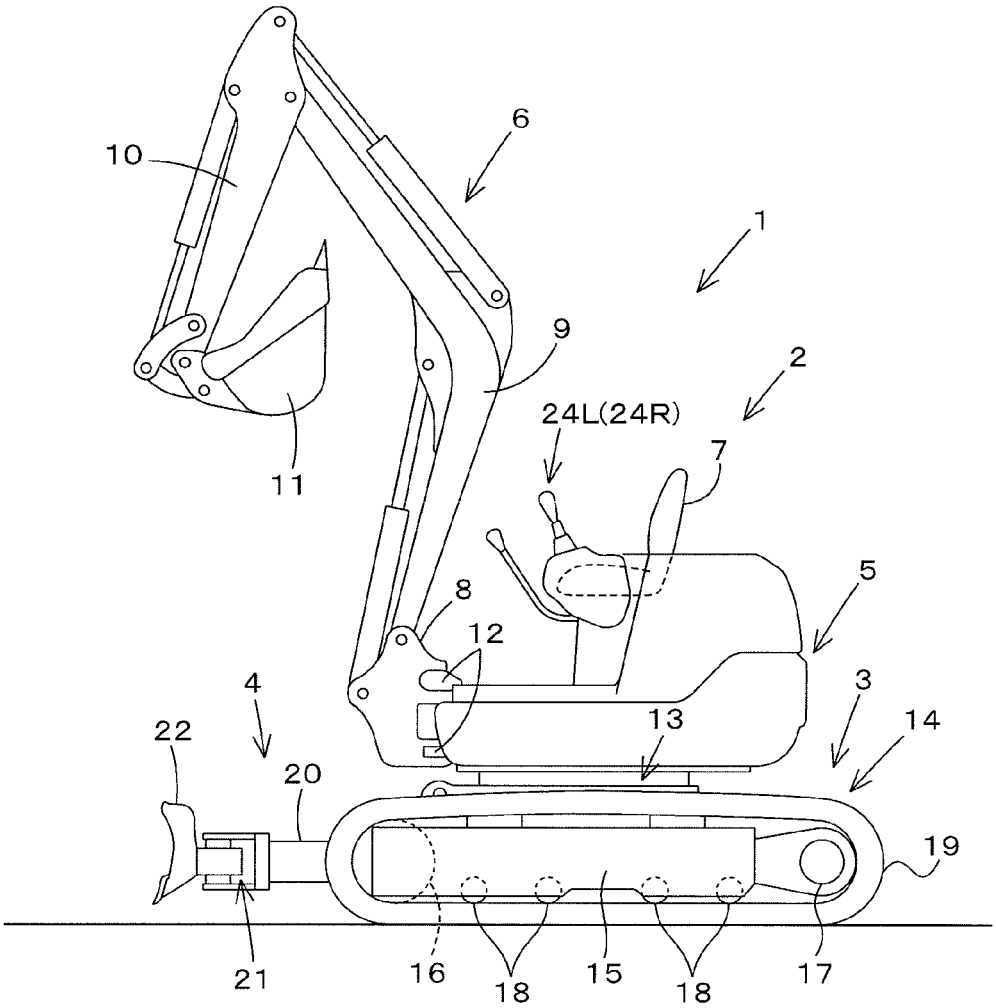
FIG. 1A is a side view showing a backhoe from the left side.

FIG. 1A illustrates a backhoe exemplified as a construction machine.

The backhoe 1 has an upper revolving body 2, a lower traveling unit 3, and a dozer unit 4 provided on the front side of the traveling unit 3.

The revolving body 2 has a revolving base 5, and an operating unit (excavating unit) 6 provided on the front side of the revolving base 5.

The revolving base 5 is supported on the traveling unit 3 revolvably around a vertical pivot, and on the revolving base 5, an operator seat 7 is provided.

The operating unit 6 has a swing bracket 8, boom 9, arm 10, and bucket 11. The swing bracket 8 is supported by a support bracket 12 provided on the front side of the revolving base 5 so as to be swingable left and right around a vertical shaft. The boom 9 is swingably supported by the swing bracket 8. The arm 10 is swingably supported on the fore end side of the boom 9. The bucket 11 is attached on the fore end side of the arm 10 so as to be able to perform a scooping/dumping action. The boom 9, arm 10, and bucket 11 are each swingably driven by hydraulic cylinders.

The traveling unit 3 is configured by providing crawler type traveling devices 14 on both of left and right sides of a traveling main frame 13. The crawler type traveling devices 14 have a track frame 15. The track frame 15 rotatably supports an idler 16, a driving wheel 17, and track rollers 18 on each of the left and right sides. On the idler 16, driving wheel 17, and track rollers 18, an endless belt-shaped elastic crawler 19 is wound. The driving wheel 17 is made drivable by an actuator such as a hydraulic motor.

Figure 1B:
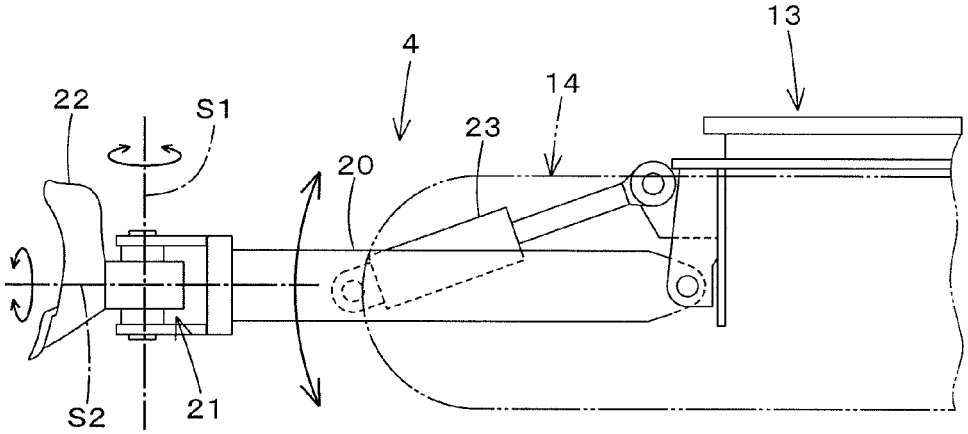
FIG. 1B is a side view showing a dozer from the left side.

As illustrated in FIG. 1B, the dozer unit 4 has: a swing frame 20 vertically swingably supported by the traveling main frame 13; and a blade 22 attached to the front of the swing frame 20 through a cross pin structure 21.

The swing frame 20 is vertically swingably driven by a dozer cylinder 23 set between the traveling main frame 13 and the swing frame 20. By vertically swinging the swing frame 20, the blade 22 performs an up and down action.

The cross pin structure 21 is located in the lateral center on the back surface side of the blade 22. The cross pin structure 21 is supported by the front of the swing frame 20 so as to be rotatable around the center of an angle shaft S1 by a predetermined angle. In addition, the cross pin structure 21 supports the blade 22 rotatably around the center of a tilt shaft S2 by a predetermined angle.

The angle shaft center S1 and the tilt shaft center S2 are orthogonal to each other. For example, as illustrated in FIG. 1B, in a state where the swing frame 20 lies along the front-back direction, the angle shaft center S1 is a shaft center in the vertical direction, and the tilt shaft center S2 is a shaft center in the front-back direction.

The blade 22 is swingable around the angle shaft center S1 as well as around the tilt shaft center S2. By swinging the blade 22 around the angle shaft center S1, the blade 22 performs an angle action (the left or right side part of the blade 22 performs a forward and backward action). By swinging the blade 22 around the tilt shaft center S2, the blade 22 performs a tilting action (the left or right side part of the blade 22 performs an up and down action).

The tilting and angle actions of the blade 22 are each performed with unillustrated hydraulic cylinders.

Figure 2:
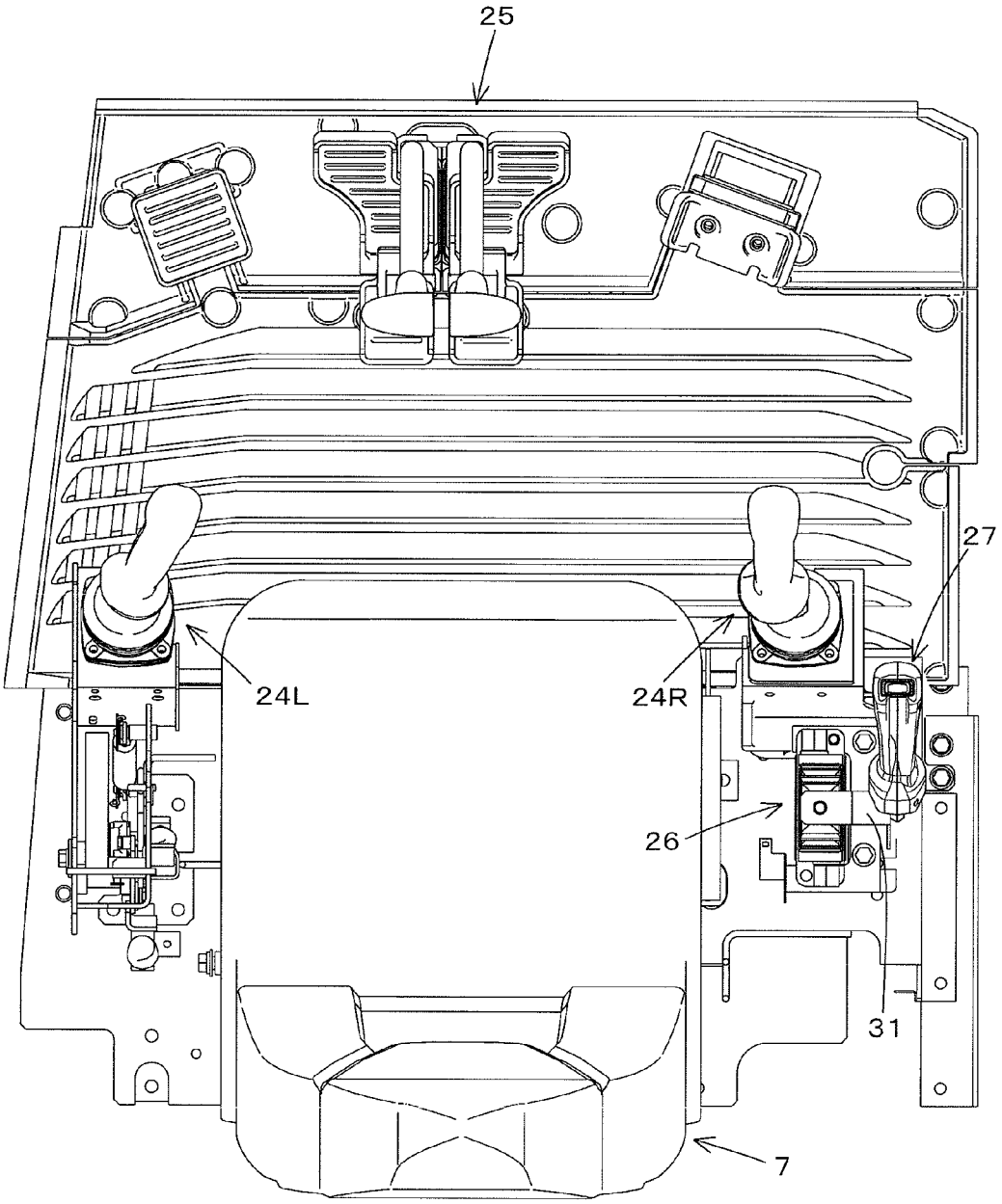
FIG. 2 is a plan view around an operator seat.

As illustrated in FIG. 2, on both of the left and right sides of the front of the operator seat 7, control levers 24L and 24R are provided. In front of the operator seat 7, a travel operation lever 25 is provided. For example, the right control lever 24R is for controlling the boom 9 and the bucket 11, whereas the left control lever 24L is for controlling the revolving base 5 and the arm 10. Further, the travel operation lever 25 is for operating the traveling unit 3.

In addition, on the right side of the operator seat 7, a remote control valve 26 for operating the dozer cylinder 23, and a dozer lever 27 (hereinafter referred to as an operation lever) for operating the remote control valve 26 (operating the dozer unit 4) are provided.

The remote control valve 26 is configured to include a pilot valve for pilot-operating a dozer control valve for controlling the dozer cylinder 23.

Figure 3:
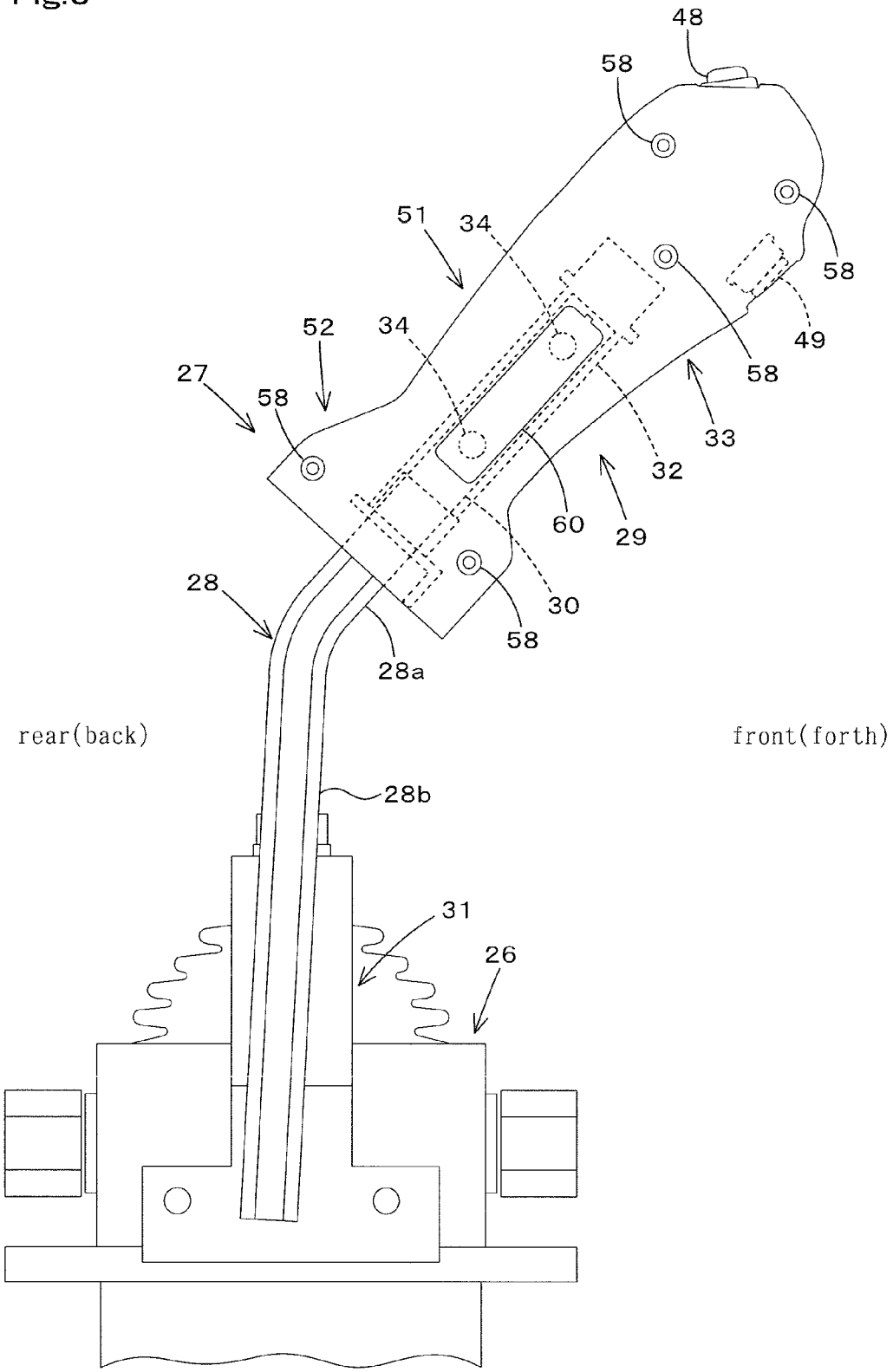
FIG. 3 is a side view of an operation lever seen from the right side of the backhoe.

As illustrated in FIG. 3 that is a side view as viewed from the right side of the backhoe 1, the operation lever 27 has a lever shaft 28 and a grip 29 attached to the lever shaft 28.

The lever shaft 28 is formed of a hexagonal bar. The lever shaft 28 is bent in the longitudinal middle. The upper part 28*a* of the lever shaft 28 is tilted forward (extended forward and upward toward the top), whereas the lower part 28*b* is slightly tilted forward (extended backward and downward toward the bottom). The lower part of the lever shaft 28 is fixed to a lever bracket 31 attached to the remote control valve 26. The lever shaft 28 is supported by the remote control valve 26 swingably back and forth through the lever bracket 31.

As illustrated in FIG. 3, by swinging the lever shaft 28 (operation lever 27) back and forth from a neutral position, the remote control valve 26 is actuated, and the swing frame 20 of the dozer unit 4 swings up and down. The swing frame 20 swings up and down, and thereby the blade 22 performs the up and down action. Specifically, by operating the operation lever 27 forward from the neutral position, the blade 22 performs a down action, whereas by operating the operation lever 27 backward from the neutral position, the blade 22 performs an up action.

As illustrated in FIG. 3, the grip 29 is provided on the upper part 28*a* of the lever shaft 28. The grip 29 is tilted in the same direction as the tilt direction of the upper part 28*a* of the lever shaft 28.

The grip 29 mainly includes a grip core member 32 and a grip main body 33. The grip core member 32 is fitted at the outside of the upper part 28*a* of the lever shaft 28, and fixed to the lever shaft 28 with attaching screws 34.

The grip main body 33 covers the grip core member 32. The grip main body 33 is supported by the grip core member 32 rotationally operably around the shaft center of the lever shaft 28 counterclockwise or clockwise from a neutral position by a predetermined angle. This makes the grip 29 rotationally operable, and the rotational operation of the grip 29 makes the blade 22 perform the angle action.

Figure 4:
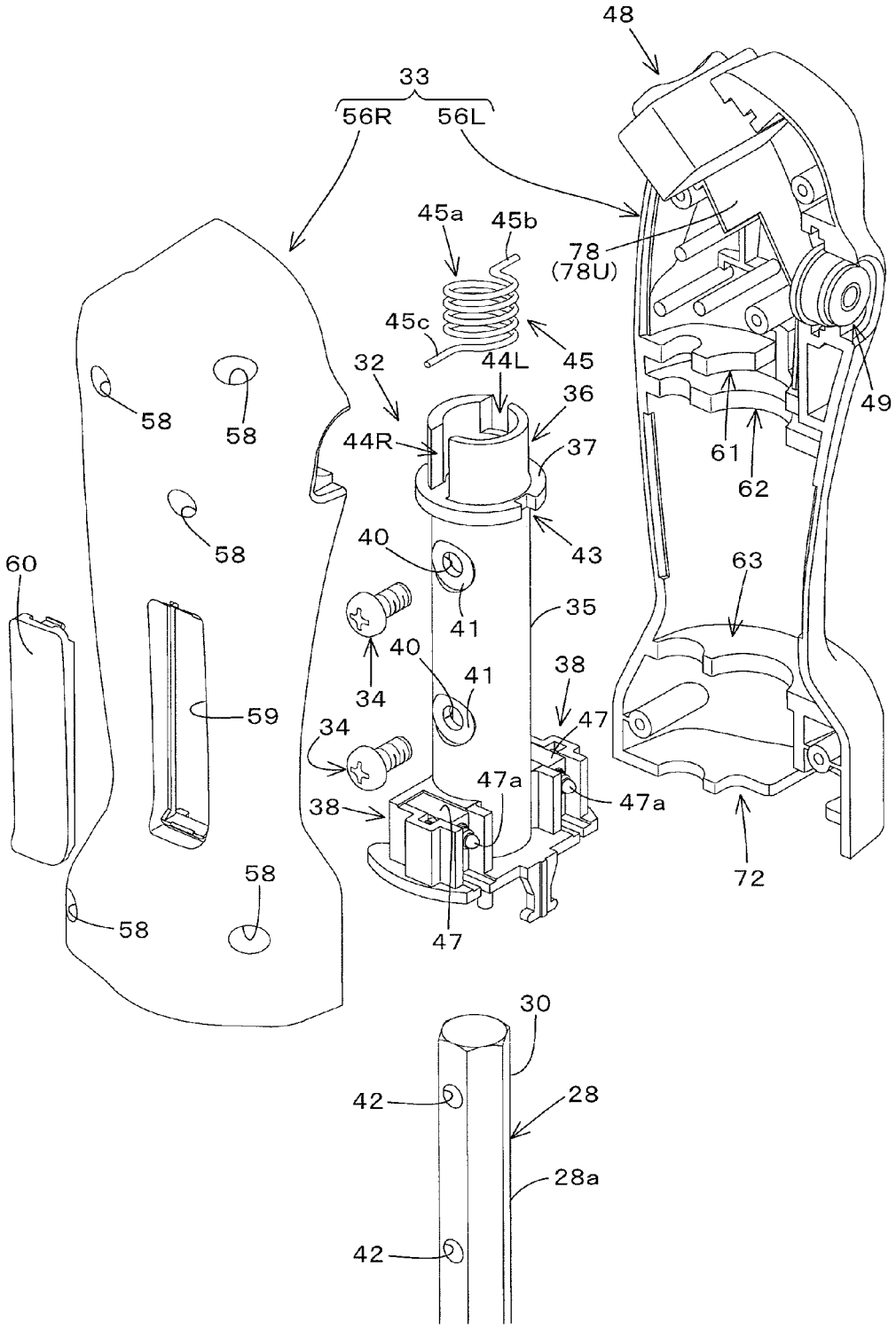
FIG. 4 is an exploded perspective view of the operation lever.
Figure 5:
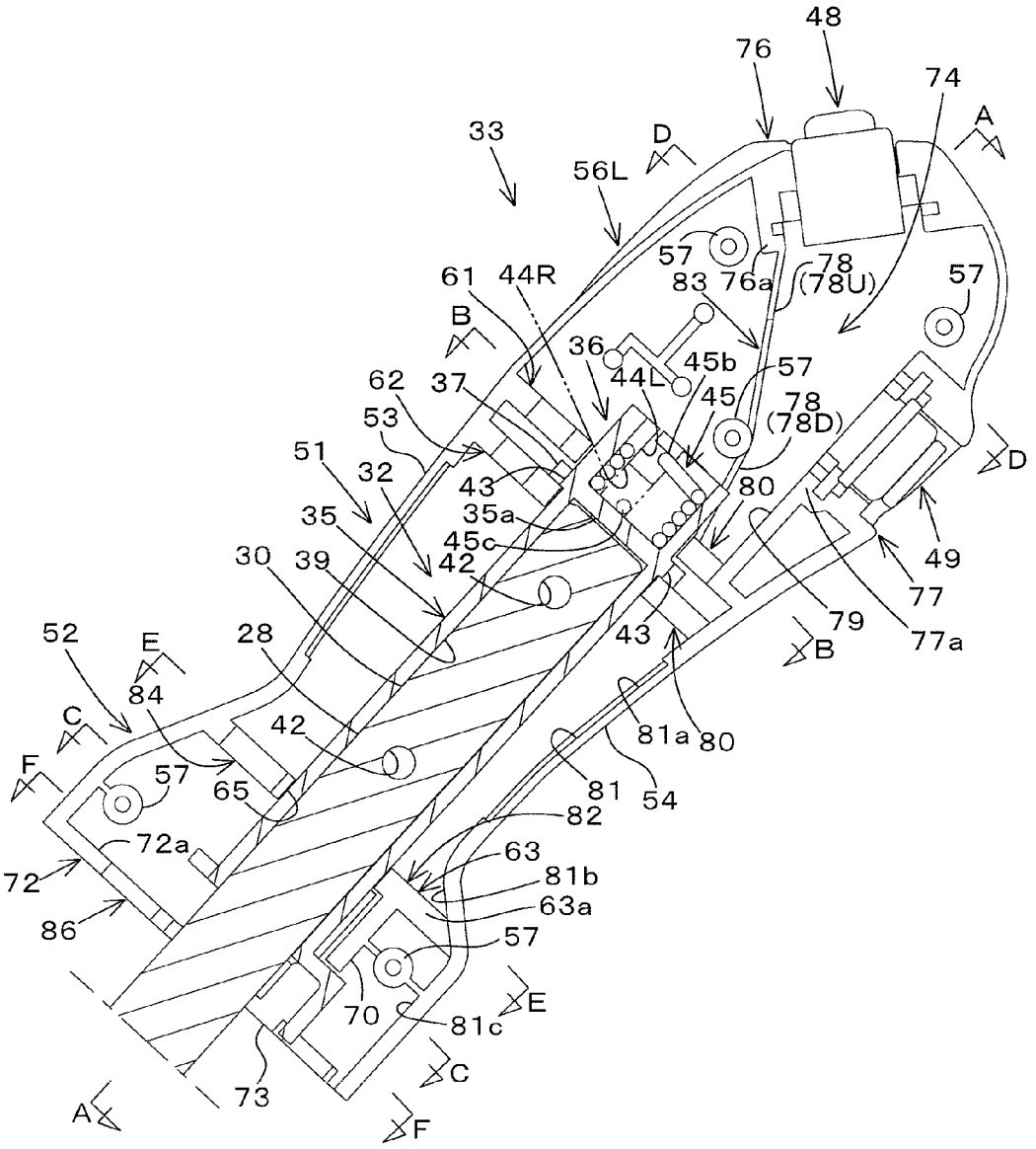
FIG. 5 is a side view showing the inside of a grip seen from the right side of the backhoe.
Figure 6:
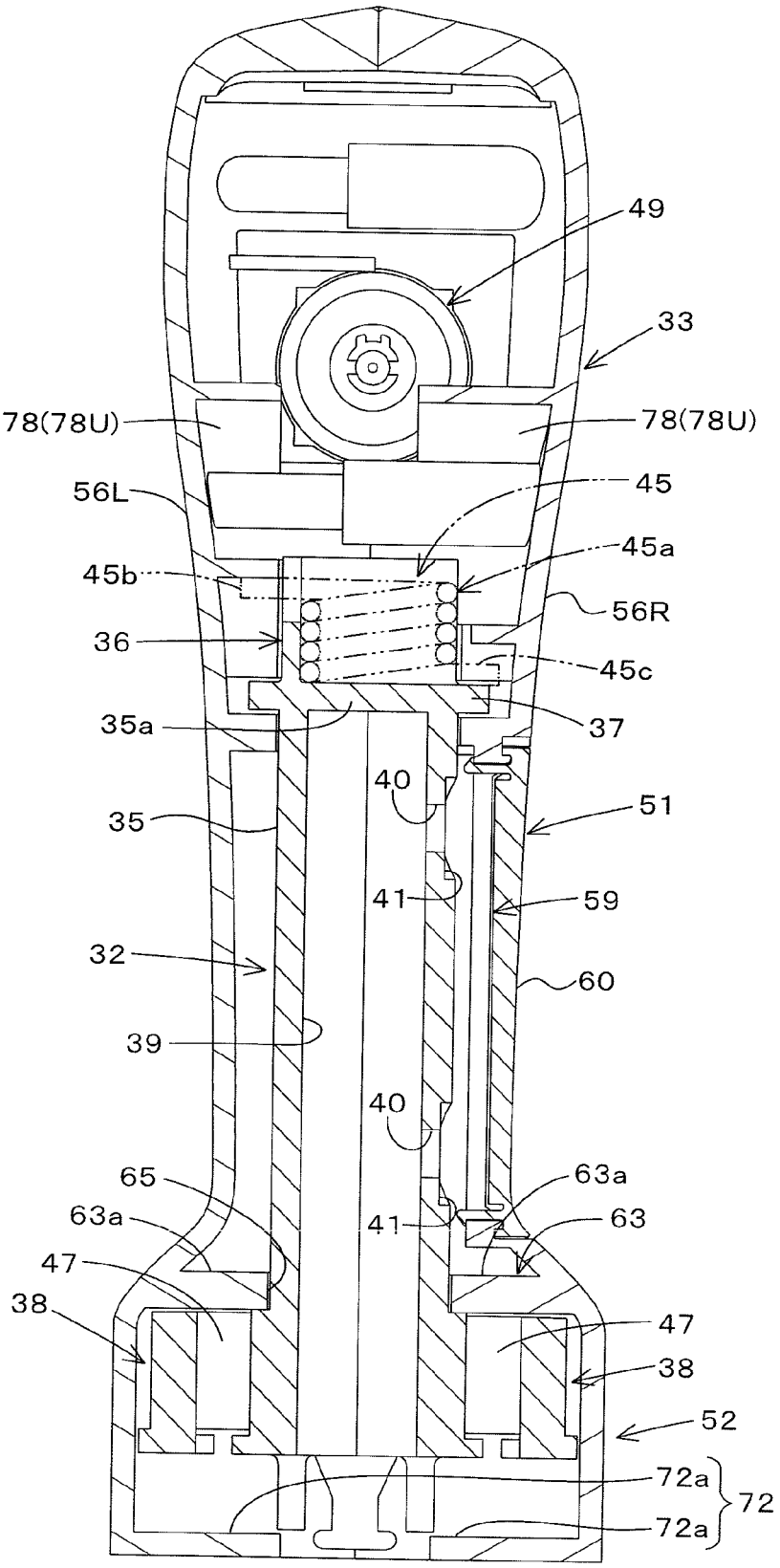
FIG. 6 is a cross-sectional view along the A-A arrowed line in FIG. 5.

As illustrated in FIGS. 4, 5, and 6, the grip core member 32 has an outer fit part 35, spring containing part 36, flange part 37, and sensor attachment parts 38. The outer fit part 35 is a tubular body that is fitted at the outside of the upper part 28*a* of the lever shaft 28. The spring containing part 36 is provided on the upper side of the outer fit part 35 in the shaft direction. The flange part 37 protrudes radially outward from the upper end of the outer fit part 35. The sensor attachment parts 38 are provided in the lower part of the outer fit part 35.

The outer fit part 35 is configured such that the upper end in the shaft direction is blocked by an upper wall 35*a*, and the lower end in the shaft direction is opened. The inner hole of the outer fit part 35 serves as a fit hole 39 that is fitted at the outside of a fit part 30 of the upper part 28*a* of the lever shaft 28. The fit hole 39 is formed as a hexagonal hole of which a cross-sectional shape is coincident with the cross-sectional shape of the lever shaft 28. Accordingly, the fit part 30 of the lever shaft 28 is fitted with fit hole 39 in a surface contact manner by fitting the outer fit part 35 at the outside of the fit part 30 of the upper part 28*a* of the lever shaft 28. Also, the grip core member 32 is prevented from rotating around the shaft center of the lever shaft 28. That is, the grip core member 32 is prevented from rotating relative to the lever shaft 28.

The outer fit part 35 is formed in a cylindrical shape. In the middle of the outer fit part 35 in the shaft direction, a pair of upper and lower screw insertion holes 40 is formed. In the present embodiment, the screw insertion holes 40 are formed in the right lateral surface of the outer fit part 35. Also, bearing surfaces 41 with which heads of the attaching screws 34 come into contact are each formed around the screw insertion holes 40 in the outer surface of the outer fit part 35.

On the other hand, the upper part 28*a* of the lever shaft 28 is formed with screw holes 42 that are each aligned with the screw insertion holes 40 in the state where the outer fit part 35 is fitted at the outside of the upper part 28*a* of the lever shaft 28. The screw holes 42 are formed in a flat surface of the hexagonal bar forming the lever shaft 28.

The outer fit part 35 of the grip core member 32 is fitted at the outside of the upper part 28*a* of the lever shaft 28 from the fore end side. The grip core member 32 is attached by inserting and tightening the attaching screws 34 into the screw holes 42 of the lever shaft 28 and the screw insertion holes 40.

Cutout grooves 43 are formed on the front and back sides of the flange part 37.

The spring containing part 36 is formed in a substantially cylindrical shape extending from the upper end of the outer fit part 35 in the shaft direction of the outer fit part 35. Also, the sprint containing part 36 is configured such that the upper end thereof is opened and the lower end is blocked by the upper wall 35*a* of the outer fit part 35.

Groove parts 44L and 44R are formed downward from the upper end along the shaft direction on both of the left and right sides of the spring containing part 36. The left groove part 44L is formed from the upper end to middle part of the spring containing part 36 in the shaft direction. The right groove part 44R is formed from the upper end to lower end of the spring containing part 36 in the shaft direction.

The spring containing part 36 contains a return-to-neutral spring 45 adapted to return the grip main body 33 to the neutral position from a position to which the grip main body 33 is rotationally operated counterclockwise or clockwise. The return-to-neutral spring 45 is a torsion coil spring in the present embodiment.

Figure 7A:
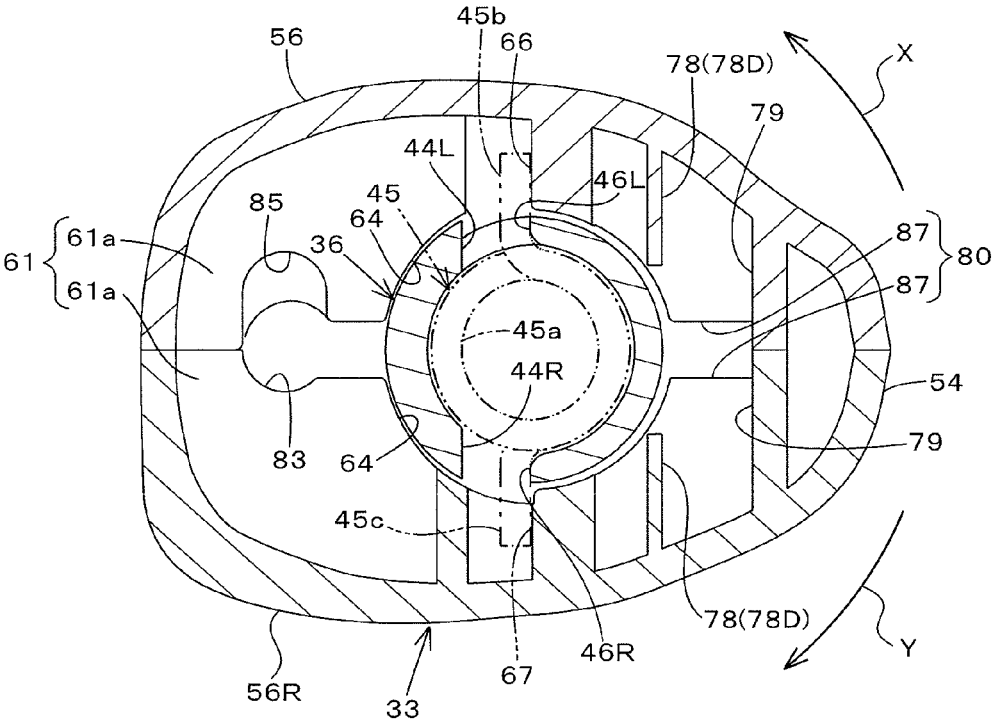
FIG. 7A is a cross-sectional view along the B-B arrowed line in FIG. 5.

As illustrated in FIGS. 6 and 7A, in the return-to-neutral spring 45, a coil part 45*a* is contained in the spring containing part 36 in a substantially concentric shape. One end part 45*b* of the spring 45 is extended from the upper end side of the coil part 45*a* so as to protrude radially outward from the spring containing part 36 through the left groove part 44L. The other end part 45*c* of the spring 45 is extended from the lower end side of the coil part 45*a* so as to protrude radially outward from the spring containing part 36 through the right groove part 44R. In addition, the one end part 45*b* and the other end part 45*c* of the return-to-neutral spring 45 are each in contact with front side end surfaces 46L and 46R of the groove parts 44L and 44R.

As illustrated in FIG. 4, the sensor attachment parts 38 are each provided on both of the outer left and right sides of the outer fit part 35. Also, each of the sensor attachment parts 38 is provided closer to the front of the outer fit part 35. Further, each of the left and right sensor attachment parts 38 has inside a space that can contain a rotation detection sensor 47 adapted to detect a rotational operation of the grip main body 33. Also, each of the left and right sensor attachment parts 38 opens upward and forward, and the rotation detection sensor 47 is inserted into the internal containing space from the upper opening.

Figure 7B:
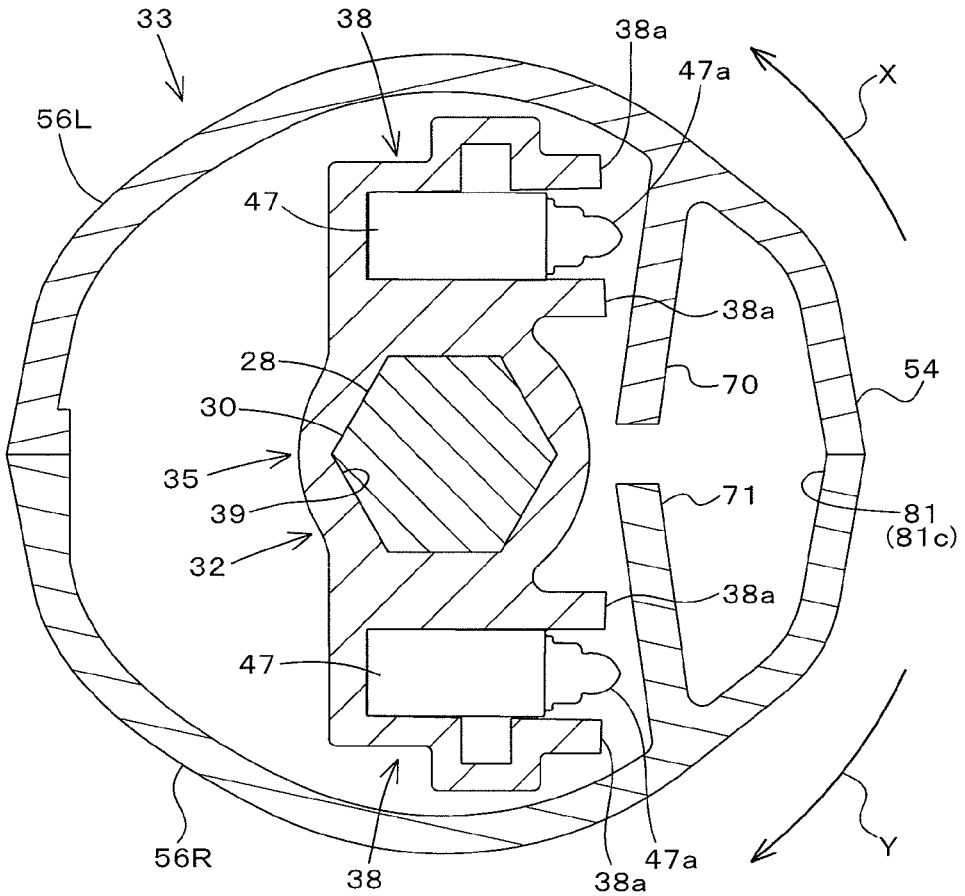
FIG. 7B is a cross-sectional view along the C-C arrowed line in FIG. 5.

As illustrated in FIG. 7B, each of the rotation detection sensors 47 is based on a contact sensor, and a contact 47*a* of the sensor 47 is protruded forward through the front opening of the sensor attachment part 38.

As illustrated in FIG. 5, in the longitudinal upper part of the grip main body 33, an operation switch 48 configured as a seesaw switch, and a selector switch 49 configured as a push-button switch are provided. The longitudinal middle part of the grip main body 33 is configured as a gripping part 51 for an operator to grip the grip 29. The longitudinal lower part of the grip main body 33 is configured as a sensor containing part 52 for containing the sensor attachment parts 38 and rotation detection sensors 47 of the grip core member 32.

The operation switch 48 is provided in the upper end part of the back side wall part 53 of the grip main body 33 (at the top of the grip main body 33), and operated with the thumb. The selector switch 49 is arranged on the lower front side of the operation switch 48, provided on the upper end side of the front side wall part 54 of the grip main body 33, and operated with an index finger (or middle finger).

The operation switch 48 is for making the blade 22 of the dozer unit 4 perform the tilting action. When pressing the left side of the operation switch 48, the blade 22 performs the tilting action to raise one (e.g., the left) of the left and right of the blade 22. When pressing the right side of the operation switch 48, the blade 22 performs the tilting action to lower one of the left and right of the blade 22.

The selector switch 49 switches the travel speed of the backhoe 1 between two levels, higher and lower.

As illustrated in FIGS. 8A, 8B, 9A, and 9B, the grip main body 33 is formed in a hollow shape so as to be able to internally arrange the grip core member 32. The grip main body 33 is configured to include a left grip main body component 56L and a right grip main body component 56R.

On the inner side of each of the left and right grip main body components 56L and 56R, multiple connecting tubes 57 are protruded laterally inward. In the present embodiment, of the connecting tubes 57, three are provided in the longitudinal upper part of the grip main body 33, and two are provided in the longitudinal lower part of the grip main body 33.

As illustrated in FIG. 4, in the right grip main body component 56R, screw insertion holes 58 communicatively connected to corresponding ones of the connecting tubes 57 are formed. The connecting tubes 57 of the left grip main body component 56L and corresponding ones of the connecting tubes 57 of the right grip main body component 56R face to each other in the lateral direction. By inserting unillustrated connecting screws, which are inserted into the connecting tubes 57 of the right grip main body component 56R, into the screw insertion holes 58, and then screwing the connecting screws into the connecting tubes 57 of the left grip main body component 56L, the right and left grip main body components 56R and 56L are connected to each other.

Also, as illustrated in FIGS. 4 and 6, the right grip main body component 56R is formed with an attachment opening 59. The attachment opening 59 is formed in the right grip main body component 56R in a location corresponding to the upper and lower screw insertion holes 40 formed in the outer fit part 35 of the grip core member 32. The attachment opening 59 is formed long in the longitudinal direction of the grip main body 33 so as to correspond to the pair of upper and lower screw insertion holes 40. The attaching screws 34 for attaching and fixing the grip core member 32 are inserted into the screw insertion holes 40 of the outer fit part 35 of the grip core member 32 through the attachment opening 59.

Also, the right grip main body component 56R is provided with a cover 60 adapted to be fitted into the attachment opening 59 to block the attachment opening 59. The cover 60 is detachably attached to the top and bottom of the attachment opening 59 by claw fitting.

Further, supported walls 61 and 62 supported rotatably around the shaft center are provided inside the grip main body 33 and in the upper part of the grip core member 32. A supporting wall 63 supported rotatably around the shaft center of the grip core member 32 is provided inside the grip main body 33 and in the lower part of the grip core member 32. The supported walls 61 and 62 and the supporting wall 63 make it possible for the grip core member 32 to support the grip main body 33 rotatably operably around the shaft center of the lever shaft 28.

As illustrated in FIG. 5, in the longitudinal middle of the grip main body 33, the pair of upper and lower supported walls 61 and 62 are provided. The upper and lower supported walls 61 and 62 are arranged below the operation switch 48 and selector switch 49. Also, the upper and lower supported walls 61 and 62 are provided so as to be tilted backward (extended forward and downward). Further, the upper and lower supported walls 61 and 62 are located above and below the flange part 37 so as to sandwich the flange part 37 of the grip core member 32 from above and below. The flange part 37 is sandwiched between the upper and lower supported walls 61 and 62, and thereby the grip main body 33 and the grip core member 32 are restricted from relatively moving in the shaft direction of the grip core member 32.

Further, as illustrated in FIG. 7A, the supported walls 61 and 62 are each formed by coupling supported wall components 61*a* formed on the left and right grip main body components 56L and 56R together and by coupling supported wall components 62*a* formed on the left and right grip main body components 56L and 56R together. As illustrated in FIGS. 8A, 8B, 9A, and 9B, each of the supported wall components 61*a* and 62*a* is formed with an arc-shaped engagement surface 64 engaging with the outer surface of the grip core member 32. The engagement surfaces 64 of the upper supported wall components 61*a* engage with the lower end side of the outer surface of the spring containing part 36 of the grip core member 32. The engagement surfaces 64 of the lower supported wall components 62*a* engage with the upper end side of the outer surface of the outer fit part 35 of the grip core member 32. In doing so, the longitudinal middle of the grip main body 33 is rotatably supported by the upper part of the grip core member 32.

As illustrated in FIG. 5, the supporting wall 63 is provided on the upper end side of the sensor containing part 52 of the grip main body 33 so as to be tilted backward (extended forward and downward). On the lower side of the supporting wall 63, the sensor attachment parts 38 and the rotation detection sensors 47 are contained.

Figure 10A:
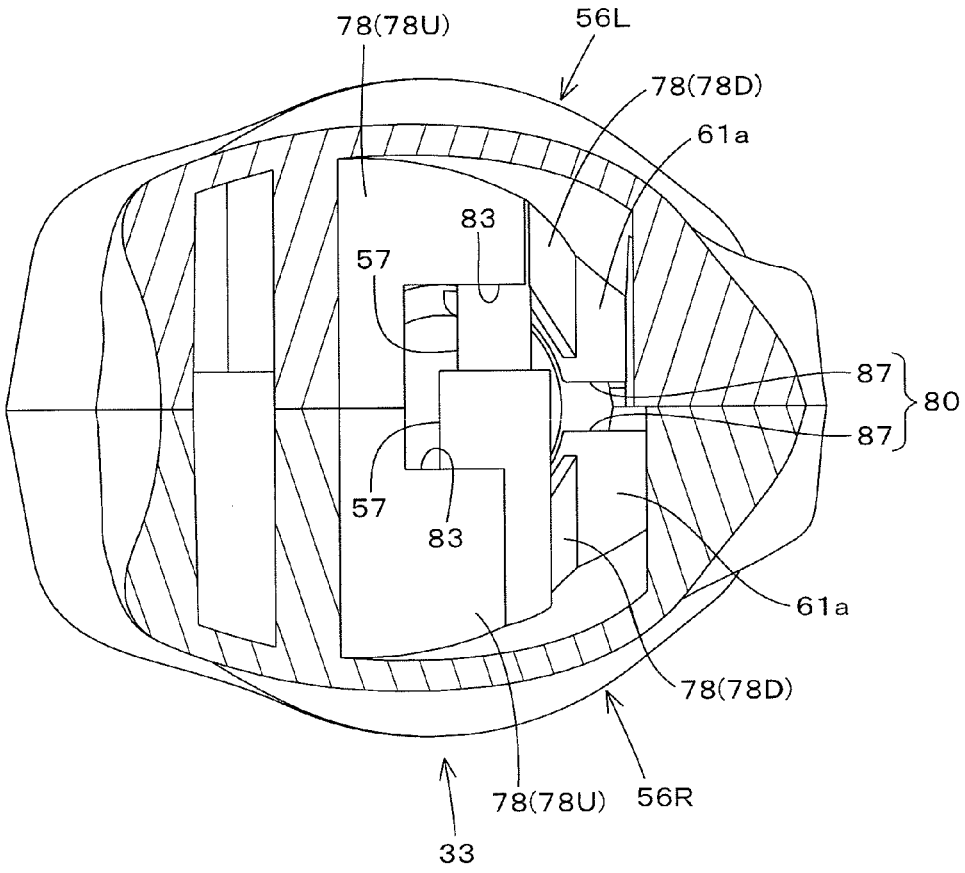
FIG. 10A is a cross-sectional view along the D-D arrowed line in FIG. 5.
Figure 10B:
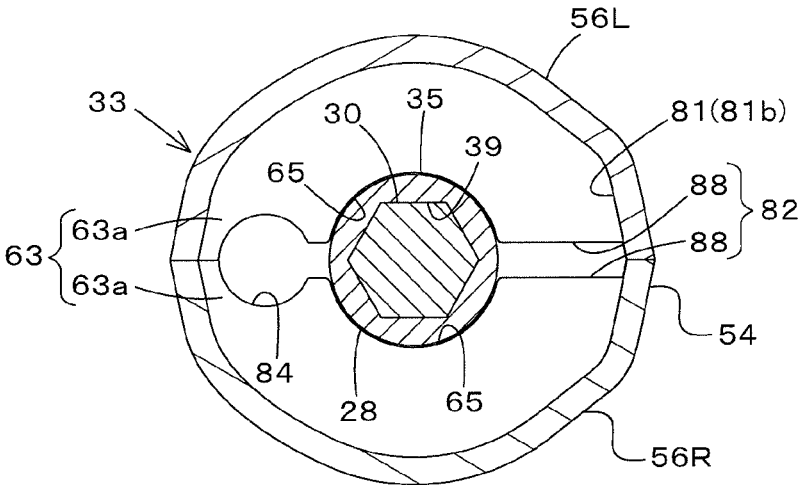
FIG. 10B is a cross-sectional view along the E-E arrowed line in FIG. 5.
Figure 10C:
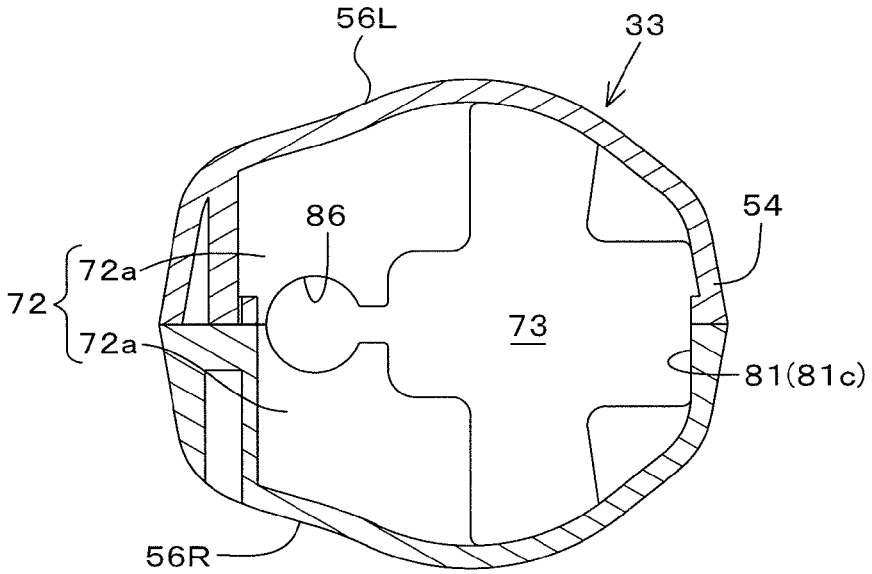
FIG. 10C is a cross-sectional view along the F-F arrowed line in FIG. 5.

As illustrated in FIG. 10B, the supporting wall 63 is formed by coupling supporting wall components 63*a* respectively formed on the left and right grip main body components 56L and 56R together. Each of the supporting wall components 63*a* is formed with an arc-shaped engagement surface 65 engaging with the outer surface of the grip core member 32. The engagement surface 65 engages with the lower part of the outer surface of the outer fit part 35 of the grip core member 32. In doing so, the longitudinally lower part of the grip main body 33 is rotatably supported by the lower part of the grip core member 32.

As illustrated in FIG. 7A, the left grip main body component 56L is provided with a first pressing surface 66 coming into contact with the one end part 45*b* of the return-to-neutral spring 45 from the front side. The right grip main body component 56R is formed with a second pressing surface 67 coming into contact with the other end part 45*c* of the return-to-neutral spring 45 from the front side.

Figure 8A:
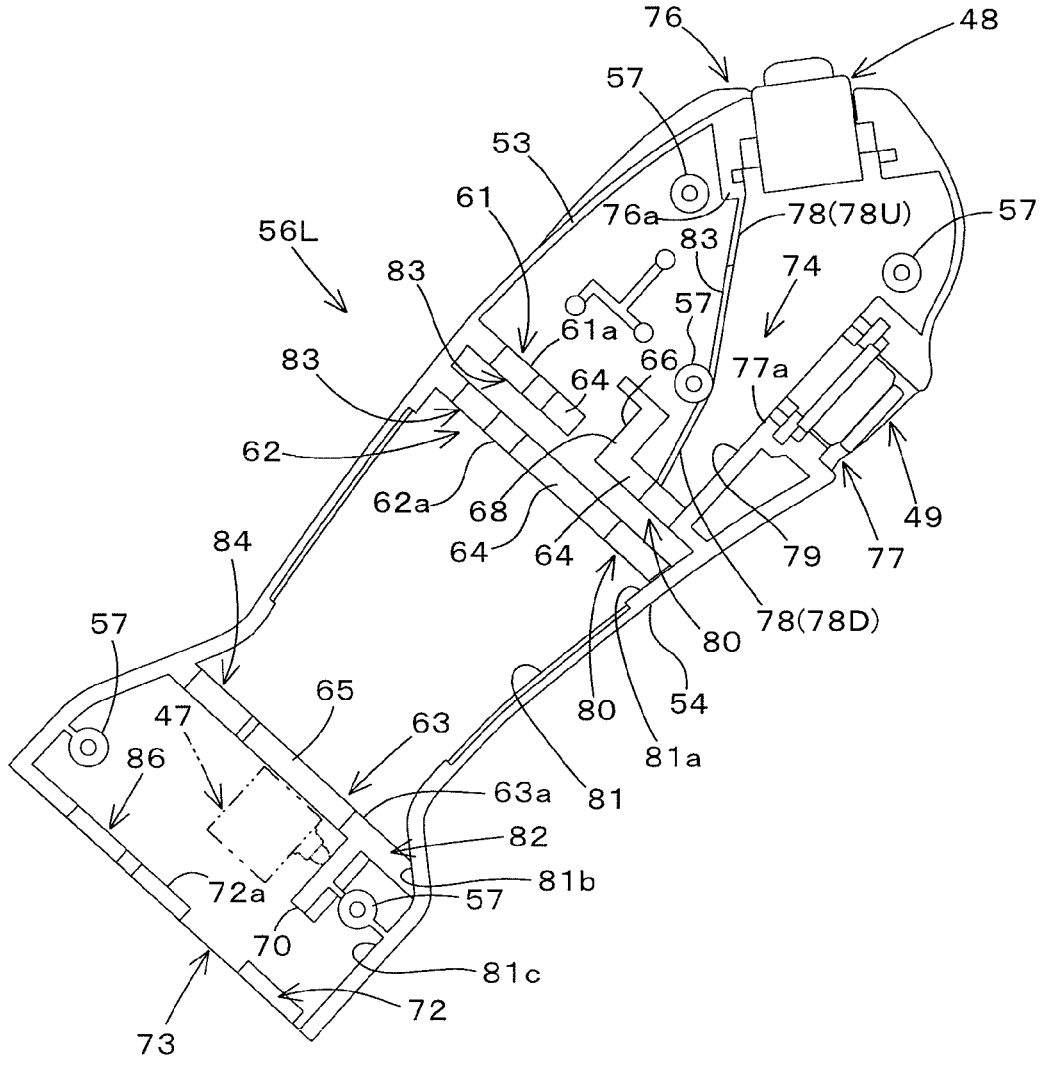
FIG. 8A is a side view showing the inside of a left grip main body component.
Figure 8B:
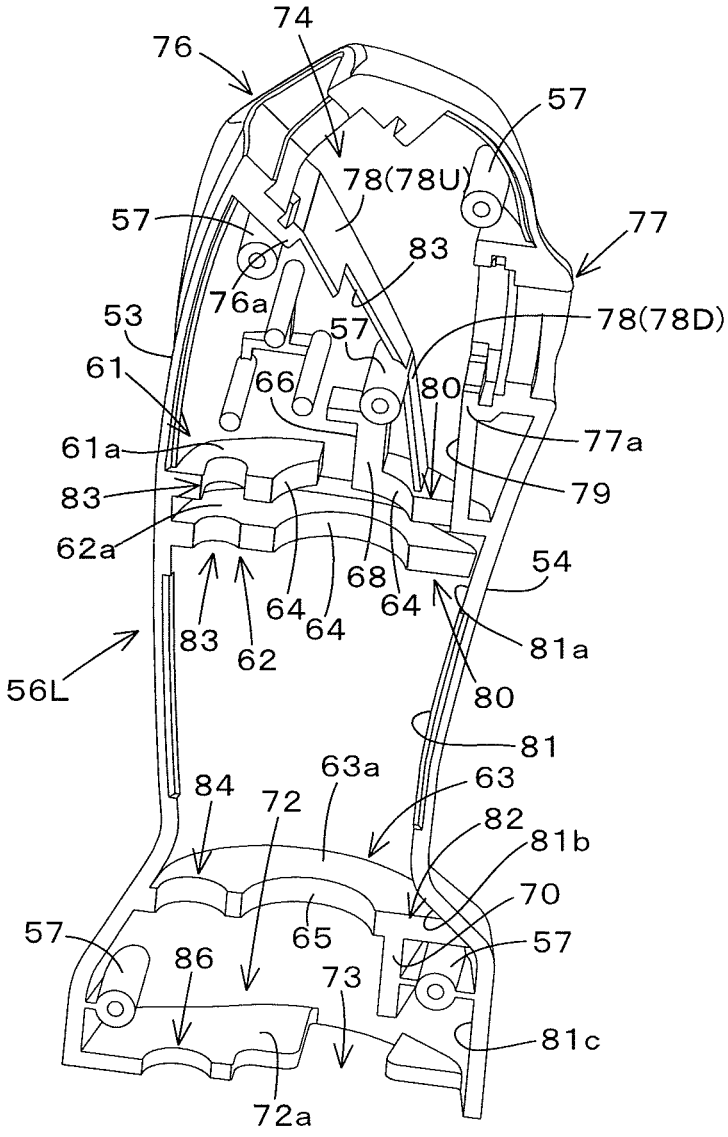
FIG. 8B is a perspective view showing the inside of the left grip main body component.
Figure 9A:
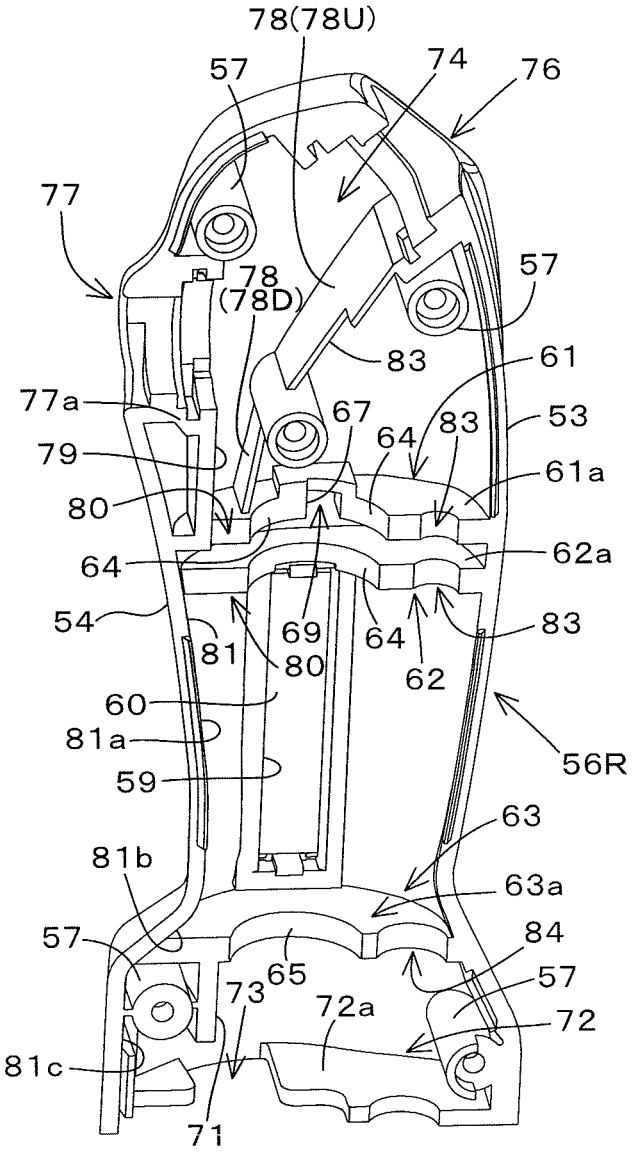
FIG. 9A is a side view showing the inside of a right grip main body component.
Figure 9B:
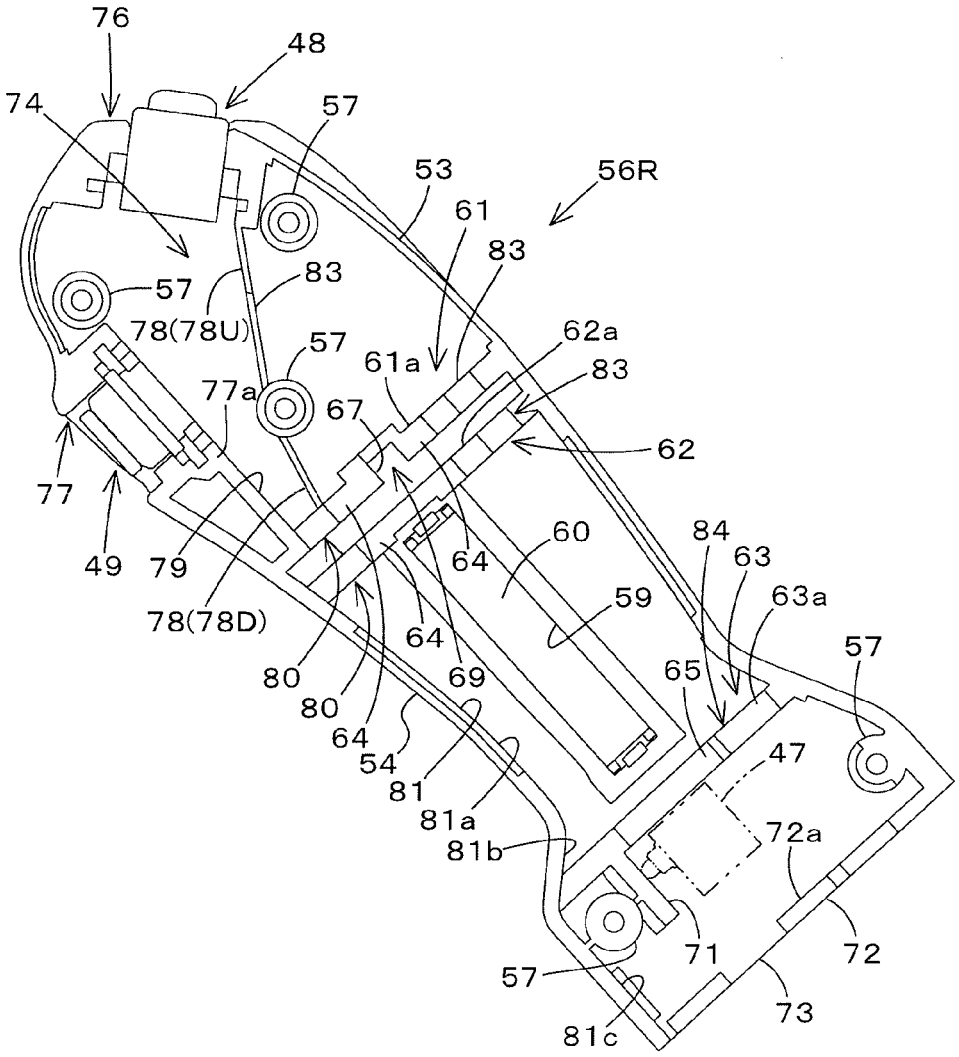
FIG. 9B is a perspective view showing the inside of the right grip main body component.

As illustrated in FIGS. 8A and 8B, the first pressing surface 66 corresponds to the back surface of an extension wall 68 that rises upward from the left upper supported wall component 61*a*. On the other hand, as illustrated in FIGS. 9A and 9B, the second pressing surface 67 corresponds to the front side surface of a cutout part 69 formed in the right upper supported wall component 61*a*.

Also, as illustrated in FIG. 7B, on the left grip main body component 56L, a first contact wall 70 is formed. The first contact wall 70 is located on the front side of the left rotation detection sensor 47. Also, the first contact wall 70 is formed so as to extend laterally inward from the inner lateral surface of the left grip main body component 56L. The first contact wall 70 is, as illustrated in FIGS. 8A and 8B, connected to the lower surface of the supporting wall component 63*a* of the left grip main body component 56L.

On the other hand, as illustrated in FIG. 7B, on the right grip main body component 56R, a second contact wall 71 is formed. The second contact wall 71 is located on the front side of the right rotation detection sensor 47. Also, the second contact wall 71 is formed so as to extend laterally inward from the inner lateral surface of the right grip main body component 56R. The second contact wall 71 is, as illustrated in FIGS. 9A and 9B, connected to the lower surface of the supporting wall component 63*a* of the right grip main body component 56R.

Figure 11:
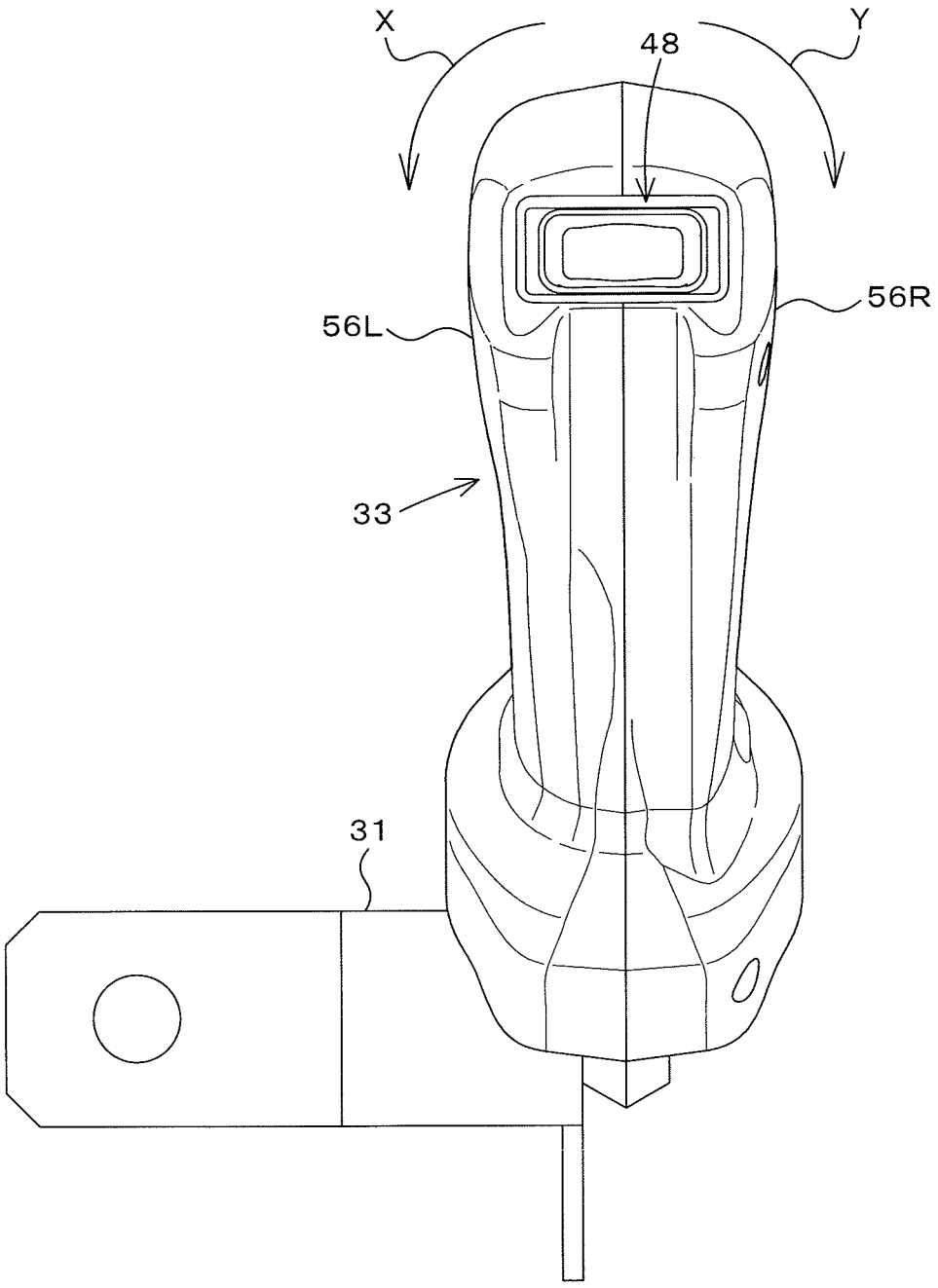
FIG. 11 is a plan view showing the operation lever.

In the operation lever 27 having such a configuration, the grip main body 33 is rotationally operated counterclockwise (in a direction indicated by the arrow X in FIGS. 7A, 7B, and 11, or in the X direction) from the neutral position illustrated in FIGS. 7A, 7B, and 11. In doing so, the first pressing surface 66 presses the one end part 45*b* of the return-to-neutral spring 45 to thereby twist the return-to-neutral spring 45. Also, the first contact wall 70 comes into contact with the contact 47*a* of the left rotation detection sensor 47 to detect the counterclockwise rotational operation of the grip main body 33. At this time, the first contact wall 70 comes into contact with a fore end 38*a* of the left sensor attachment part 38, and thereby the grip main body 33 is restricted from further rotating counterclockwise. In other words, the fore end of the left sensor attachment part 38 serves as a stopper for restricting the grip main body 33 from further rotating counterclockwise.

When the counterclockwise rotational operation of the grip main body 33 is detected, the blade 22 of the dozer unit 4 performs, for example, the angle action of swinging counterclockwise around the angle shaft center S1.

Further, in the case of releasing the operational force acting on the grip main body 33 in the X direction, the returning force of the return-to-neutral spring 45 (the restoring force of the torsion coil spring) restores the grip main body 33 to the neutral position to stop the angle action.

On the other hand, in the case of rotationally operating the grip main body 33 clockwise (in a direction indicated by the arrow Y in FIGS. 7A, 7B, and 11, or in the Y direction) from the neutral position illustrated in FIGS. 7A, 7B, and 11, the second pressing surface 67 presses the other end part 45*c* of the return-to-neutral spring 45 to thereby twist the return-to-neutral spring 45. Also, the second contact wall 71 comes into contact with the contact 47*a* of the right rotation detection sensor 47 to detect the clockwise rotational operation of the grip main body 33. Further, the second contact wall 71 simultaneously comes into contact with a fore end 38*a* of the right sensor attachment part 38, and thereby the grip main body 33 is restricted from further rotating clockwise. In other words, the fore end of the right sensor attachment part 38 serves as a stopper for restricting the grip main body 33 from further rotating clockwise.

When the clockwise rotational operation of the grip main body 33 is detected, the blade 22 of the dozer unit 4 performs, for example, the angle action of swinging clockwise around the angle shaft center S1.

Further, in the case of releasing the operational force acting on the grip main body 33 in the Y direction, the returning force of the return-to-neutral spring 45 (the restoring force of the torsion coil spring) restores the grip main body 33 to the neutral position to stop the angle action.

In the present embodiment, the operation lever 27 is provided on the right side of the operator seat 7. Therefore, an operator normally grips the grip 29 of the operation lever 27 by the right hand. In this case, the operator can rotationally operate the grip main body 33 in the X direction by flexing the wrist toward the palmar side (palmar flexion state), whereas the operator can rotationally operate the grip main body 33 in the Y direction by flexing the wrist toward the dorsal side (dorsiflexion state).

Also, in the case where the operator rotationally operates the grip main body 33 against the spring force of the return-to-neutral spring 45, a load is imposed on the operator's wrist. Further, in the case where a rotational operation angle by which the grip main body 33 is rotationally operated in the palmar flexion state and a rotational operating angle by which the grip main body 33 is rotationally operated in the dorsiflexion state are made equal to each other, rotationally operating the grip main body 33 in the palmar flexion state makes the load imposed on the operator larger than rotationally operating the grip main body 33 in the dorsiflexion state.

For this reason, in the present embodiment, the rotational operation angle by which the grip main body 33 is rotationally operated with the wrist flexed in the palmar side is made smaller than the rotational operation angle by which the grip main body 33 is rotationally operated with the wrist flexed toward the dorsal side. Specifically, in the present embodiment, the rotational operation angle of the grip main body 33 in the X direction ("palmar flexion" direction) is set to 8°, whereas the rotational operation angle of the grip main body 33 in the Y direction ("dorsiflexion" direction) is set to 10°. In doing so, the load on the operator's wrist can be reduced to improve operability.

Also, the operation lever 27 of the present embodiment is adapted to rotationally operate the grip main body 33 around the shaft center of the lever shaft 28 to thereby make the blade 22 perform the angle action. Accordingly, the up and down or angle action of the blade 22 can be performed by an operation with the grip main body 33 firmly gripped by the five fingers, and therefore operability at the time of, for example, continuously operating the up and down action and the angle action is high.

Further, in the present embodiment, the up and down action, angle action, or tilting action of the blade 22 can be performed by operating the one operation lever 27, and therefore operability is high.

Still further, by making a direction of the rotational operation of the grip main body 33 and a direction of the angle action of the blade 22 coincide with each other, the operability can be improved.

In addition, the lever shaft 28 is formed of the hexagonal bar. Also, the fit hole 39 of the grip core member 32 is formed as the hexagonal hole of which a cross-sectional shape is coincident with the cross-sectional shape of the lever shaft 28. For this reason, the grip core member 32 is prevented from rotating with respect to the lever shaft 28. In doing so, the lever shaft 28 is fitted into the fit hole 39 in the surface contact manner, and therefore even in the case of fixing the grip core member 32 to the lever shaft 28 with the screws, the screws are not easily loosened by the rotational operation of the grip main body 33. In addition, the screw fixation facilitates the assembly of the grip 29 to the lever shaft 28, and therefore the grip 29 can be easily replaced in case of grip failure, for example.

Also, the attachment surfaces of the grip core member 32 to the lever shaft 28 are flat surfaces, which is advantageous to preventing the looseness of the attaching screws 34.

Further, the grip core member 32 can be screwed and fixed to the lever shaft 28 through the attachment opening 59 formed in the grip main body 33. Accordingly, the grip 29 can be attached to/detached from the lever shaft 28 in the state where the grip core member 32 is assembled to the grip main body 33, and therefore assembling workability is high. In addition, the cover 60 can hide the attaching screws 34.

Still further, by using the hexagonal bar easily available at low cost as the lever shaft 28, the operation lever 27 can be provided at low cost.

The grip 29 of the present embodiment is structured to be rotationally operable. For this purpose, inside the grip main body 33, the rotation detection sensors 47 each adapted to detect the rotational operations of the grip main body 33 are provided, and also the grip core member 32 and the grip main body 33 are relatively rotated through a contact part therebetween.

Also, intrusion objects such as water and sand may intrude into the grip main body 33 from an attachment part 76 of the operation switch 48, and/or an attachment part 77 of the selector switch 49.

Long term exposure of any of the rotation detection sensors 47 to the intrusion objects such as water and sand intruding into the grip main body 33 causes a failure of or a reduction in life of the rotation detection sensor 47. In addition, the intrusion of sand into the contact part between the grip core member 32 and the grip main body 33 facilitates abrasion of the contact part, which affects the life of the grip 29 as well as causing failure.

For this reason, in the grip 29 of the present embodiment, an opening 73 is formed in the bottom part 72 of the grip main body 33 (see FIG. 100), and also, inside the grip main body 33, an intrusion object discharge path 74 is provided. The intrusion object discharge path 74 is adapted to discharge the intrusion objects such as water and sand, which intrude into the grip main body 33 from the attachment part 76 of the operation switch 48 and/or the attachment part 77 of the selector switch 49, from the opening 73 of the bottom part 72 of the grip main body 33 while bypassing the rotation detection sensors 47 and the contact part between the grip core member 32 and the grip main body 33.

As illustrated in FIG. 100, the bottom part 72 of the grip main body 33 is formed by coupling together bottom part components 72*a* each formed on the left and right grip main body components 56L and 56R.

As illustrated in FIGS. 5, 8A, 8B, 9A, and 9B, the intrusion object discharge path 74 includes discharge guides 78, guide surfaces 79, passage paths 80 (referred to as first passage paths), a directing surface 81, and another passage path 82 (referred to as a second passage path). The discharge guides 78 are adapted to guide the intrusion objects such as water and sand intruding from the attachment part 76 of the operation switch 48. The guide surfaces 79 are adapted to guide the intrusion objects such as water and sand intruding from the attachment part 77 of the selector switch 49. The first passage paths 80 are provided on the front end sides of the upper and lower supported walls 61 and 62. The directing surface 81 is formed by the inner surface of the front side wall part 54 of the grip main body 33. The second passage path 82 is provided on the front end side of the supporting wall 63.

In the following, the intrusion object discharge path 74 is described mainly with reference to FIGS. 5, 8A, 8B, 9A, and 9B.

The upper and lower pairs of discharge guides 78 are provided in the upper parts of the left grip main body component 56L and the right grip main body component 56R.

The left and right upper discharge guides 78U are provided so as to be extended forward and downward with respect to the grip main body 33 from a lower side wall part 76*a* of the attachment part 76 of the operation switch 48 to the upper connecting tubes 57 above the grip core member 32.

Also, the left and right upper discharge guides 78U are each formed with cutouts 85 for passing electrical wiring connected to the operation switch 48 and selector switch 49 toward the back sides of the discharge guides 78U. The electrical wiring passes through through-holes 83 formed in the back parts of the upper and lower supported walls 61 and 62 (see FIG. 7A). Also, the electrical wiring is arranged downward through a through-hole 84 formed in the back part of the supporting wall 63 (see FIG. 10B). Further, the electrical wiring is sent to the outside through a through-hole 86 provided in the bottom part 72 of the grip main body 33 (see FIG. 100).

The left and right lower discharge guides 78D are provided so as to be extended forward and downward with respect to the grip main body 33 from the connecting tubes 57 connected with the lower ends of the upper discharge guides 78U to the back end side of the first passage path 80 on the upper surface of the upper supported wall 61.

Also, the left and right lower discharge guides 78D are configured not to laterally come into contact with each other in order to prevent the interference with the spring containing part 36 of the grip core member 32 (see FIG. 7A).

The guide surfaces 79 are each provided on the left and right grip main body components 56L and 56R, and configured to laterally come into contact with each other (see FIG. 7A). Also, the guide surfaces 79 are provided so as to be tilted forward (extended downward with respect to the grip main body 33) from the lower side wall part 77*a* of the attachment part 77 of the selector switch 49 to the front end parts of the upper supported wall 61 and upper first passage path 80.

The first passage paths 80 are formed by cutouts 87 formed on the front end sides of the upper and lower supported wall components 61*a* and 62*a* (see FIGS. 7A and 10A).

The directing surface 81 has a first area 81*a* from the front end side of the lower supported wall 62 to near the upper side of the supporting wall 63. Also, the directing surface 81 has: a second area 81*b* from the lower end of the first area 81*a* to the front end of the lower surface of the supporting wall 63; and a third area 81*c* from the lower end of the second area 81*b* to the lower end of the front side wall part 54 of the grip main body 33.

The first area 81*a* is tilted so as to extend backward toward the lower side. The second area 81*b* is tilted so as to extend forward toward the lower side. The third area 81*c* is tilted so as to extend backward toward the lower side.

The second passage path 82 is formed by cutouts 88 formed on the front end sides of the left and right supporting wall components 63*a* (see FIG. 10B).

In the intrusion object discharge path 74 having such a configuration, the intrusion objects such as water and sand intruding from the attachment part 76 of the operation switch 48 move downward along the upper discharge guides 78U and lower discharge guides 78D to the first passage path 80 formed in the upper supported wall 61.

On the other hand, the intrusion objects such as water and sand intruding from the attachment part 77 of the selector switch 49 move downward along the guide surfaces 79 to the first passage path 80 formed in the upper supported wall 61.

The intrusion objects such as water and sand having reached the first passage path 80 of the upper supported wall 61 move to the upper end side of the directing surface 81 via the first passage path 80 of the upper supported wall 61 and the first passage path 80 of the lower supported wall 62, and move downward along the directing surface 81.

The intrusion objects such as water and sand moving downward along the directing surface 81 pass through the second passage path 82 provided in the supporting wall 63, and move to the lower end of the directing surface 81. The intrusion objects such as water and sand having reached the lower end of the directing surface 81 are dropped and discharged through the opening 73 of the bottom part 72 of the grip main body 33.

In the present embodiment configured as described above, the intrusion objects such as water and sand intruding into the grip main body 33 from the attachment part 76 of the operation switch 48 and/or the attachment part 77 of the selector switch 49 are guided to the opening 73 of the bottom part 72 of the grip main body 33 through the intrusion object discharge path 74 while bypassing the rotation detection sensors 47. Then, the intrusion objects are discharged from the opening 73 of the bottom part 72 of the grip main body 33. As a result, the rotation detection sensors 47 each adapted to detect the rotational operations of the grip main body 33 can be prevented from being exposed to the intrusion objects such as water and sand, and therefore a failure of or a reduction in life of any of the rotation detection sensors 47 can be prevented.

Also, in the upper and lower supported walls 61 and 62 and in the supporting wall 63, the passage paths 80 and the passage path 82 are each provided, and thereby the intrusion objects such as sand are less likely to deposit on any of the upper and lower supported walls 61 and 62 and supporting wall 63. Accordingly, abrasion facilitated by the intrusion objects such as sand into the contact part between the relatively rotating grip main body 33 and grip core member 32 can be reduced.

Further, the grip 29 is provided so as to be tilted forward (extended forward and upward), the inner surface of the front side wall part 54 of the grip main body 33 can be utilized as the directing surface 81 for guiding the intrusion objects such as water and sand to the opening 73 of the bottom part 72 of the grip main body 33.

Still further, the front side cutout groove 43 formed in the flange part 37 of the grip core member 32 is in a location corresponding to the first passage paths 80 of the upper and lower supported walls 61 and 62 when the grip main body 33 is at the neutral position. Accordingly, the intrusion objects such as water and sand move downward through the cutout groove 43. In doing so, the intrusion objects such as sand can be made less likely to deposit on the flange part 37, and therefore abrasion facilitated by the intrusion objects such as sand into any of contact parts between the relatively rotating flange part 37 and supported walls 61 and 62 can be reduced.

In the manner described above, a reduction in life of the grip 29 itself can be prevented.

Note that in the embodiment described above, design can be variously changed. For example, in the present embodiment, the blade 22 is made to perform the angle action by rotationally operating the grip 29; however, the present invention may be configured such that the blade 22 is made to perform the tilting action by rotationally operating the grip 29, and also perform the angle action by the operation switch 48.

In addition, in the case of the dozer unit 4 of which the blade 22 performs the up and down action, and one of the angle and tilting actions, the one of the angle and tilting actions is performed by rotationally operating the grip 29.

Further, the lever shaft 28 may be formed of a polygonal bar of which the cross-sectional shape is a triangle, quadrangle, or pentagon, or a polygon having at least seven sides. Also, it is only necessary that the fit part 30 of the lever shaft 28 fitted with the outer fit part 35 of the grip core member 32 is formed in at least a polygonal bar shape. Further, the operation lever 27 may be provided on the left side of the operator seat 7.

Second Embodiment

Next, a second embodiment is described on the basis of drawings.

Figure 22:
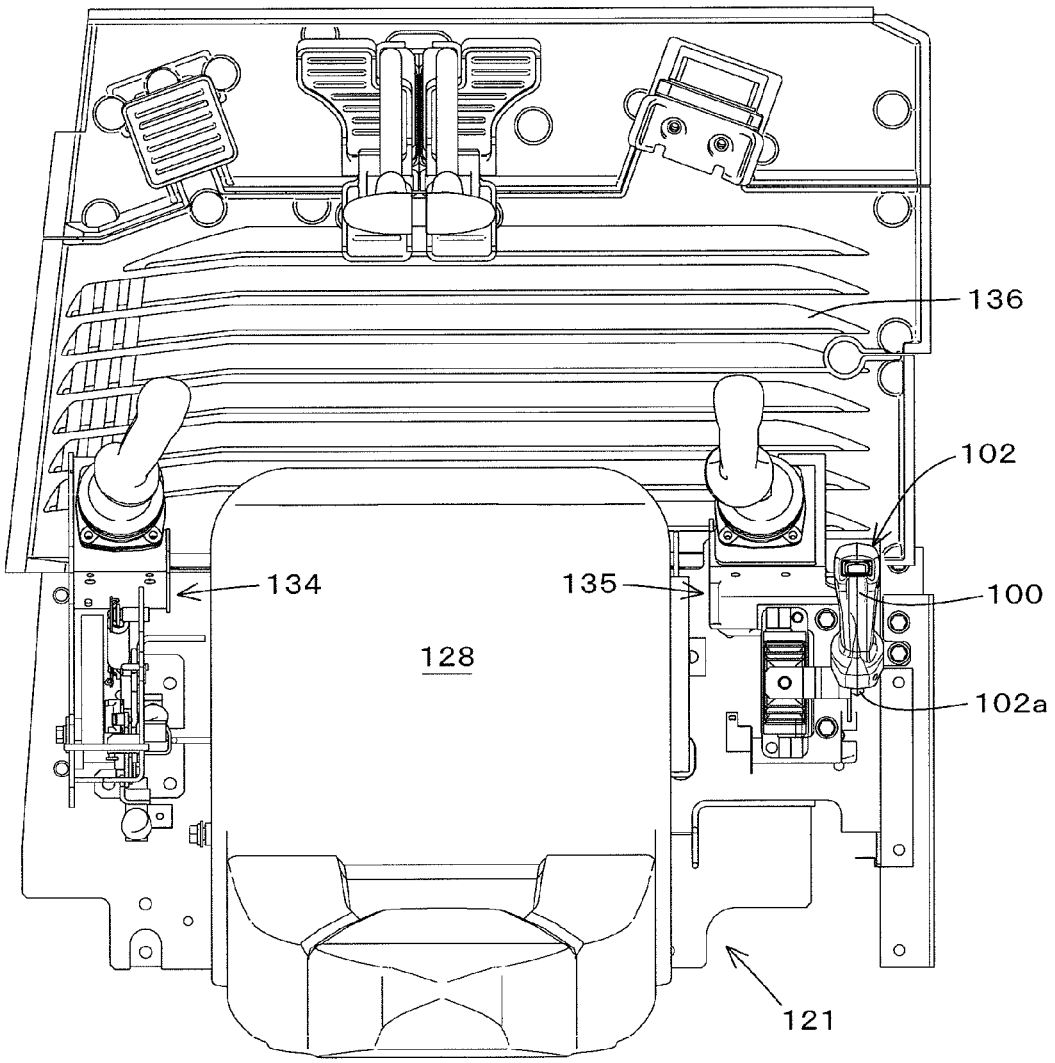
FIG. 22 is a plan view showing an application to a manual operation tool in a backhoe control part.
Figure 23:
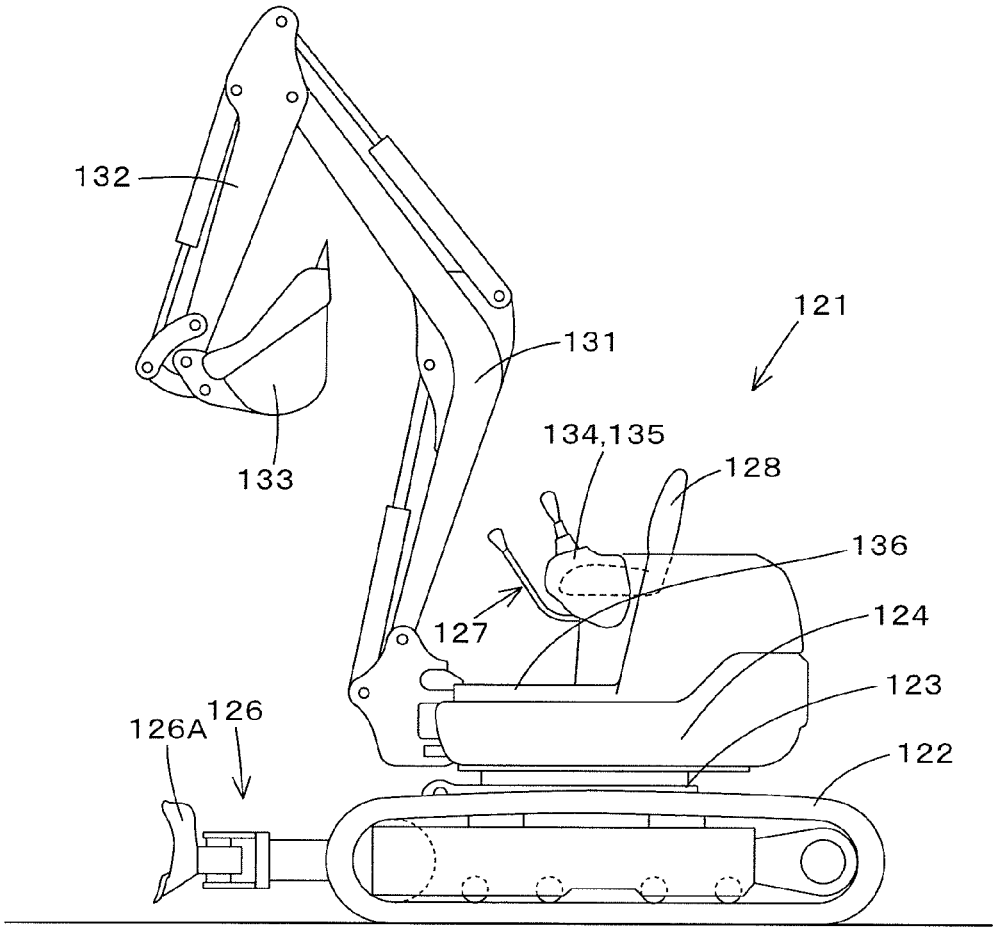
FIG. 23 is an overall side view showing a backhoe.

FIGS. 22 and 23 exemplify a backhoe 121 as an industrial machine. The backhoe 121 includes a traveling machine body 123 having left and right crawler type traveling parts 122. A revolving base 124 is supported revolvably around a vertical shaft. On the revolving base 124, a control part 127 is provided. The traveling machine body 123 supports a dozer unit 126 on the front side of the traveling machine body 123.

In the control part 127, working part operating devices 134 and 135 for making the revolving base 124, a boom 131, an arm 132, and a bucket 133 each perform a revolving action, an up and down action, a swing action, and a scooping/dumping action are arranged.

On the front side of a floor 136, a traveling control device 37 and the like are arranged. Also, on the front right side of the operator seat 128, a manual operation tool 102 (operation lever) for actuating a blade 126A of the dozer unit 126 is provided. The manual operation tool 102 includes a grip 100 constituting a grip operation part 103.

Figure 24:
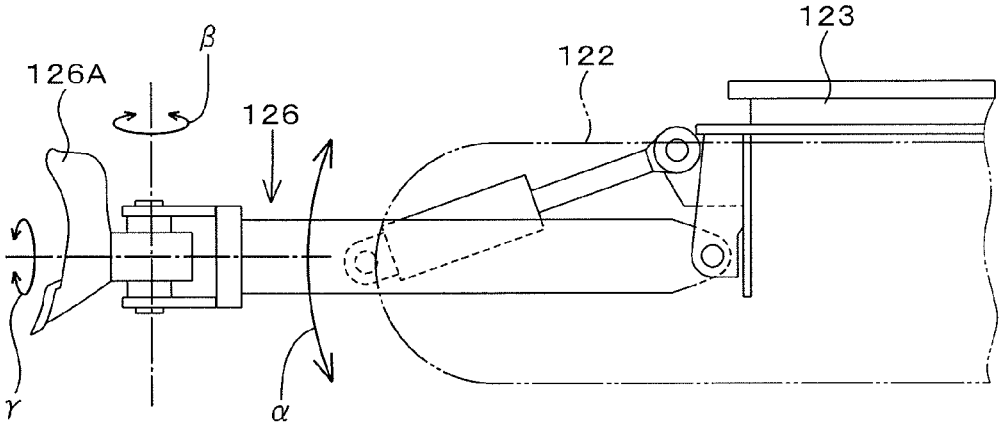
FIG. 24 is an explanatory view illustrating the actions of a dozer.

The manual operation tool 102 is attached to a lever rod 102*a*. At the upper end of the lever rod 102*a*, the grip 100 is provided. By performing a swing operation of the grip 100 in the front-back direction, the blade 126A of the dozer unit 126 performs an up and down action (in an α direction in FIG. 24). Also, by turning the grip 100 around the lever rod 102*a*, the blade 126A of the dozer unit 126 performs an angle action (a front-back action of the left or right side part of the blade 126A in a β direction in FIG. 24). Further, by performing a pressing operation of a switch at the top with the thumb, the blade 126A performs a tilting action (an up and down action of the left or right side part of the blade 126A in a γ direction in FIG. 24). Still further, by performing a pressing operation of a push button on the back surface (as viewed from an operator sitting on the operator seat 128) with the index finger, a gear shifting action of switching the travel speed of the backhoe 121 between high and low speeds is performed.

Referring to FIGS. 12 to 21, the grip 100 includes a grip main body 105, seesaw switch 106, push button 107, and turn sensors 109. The grip main body 105 is turnably fitted on the lever rod 102*a* of the manual operation tool 102 through a support shaft body 140, and gripped by the palm and finger (including the index finger, middle finger, third finger, and little finger). The seesaw switch 106 is arranged at the top 160 of the grip main body 105 and operable with the thumb. The push button 107 is arranged in the upper front part of the grip main body 105 (on the back surface of the grip main body 105 as viewed from an operator sitting on the operator seat 128) and operated with the index or middle finger. The turn sensors 109 are provided between the lower part of the grip main body 105 and the support shaft body 140 to detect a turn of the grip main body 105.

The grip 100 illustrated is for right hand use. The grip 100 is arranged in a forward tilting position from the bottom to the top. The grip main body 105 is formed of synthetic resin as left and right half parts, which are coupled together along the centerline (divided surface) S and screwed, and fitted on the support shaft body 140 turnably around the shaft center.

As illustrated in FIGS. 15, and 18 to 21, the support shaft body 140 is fitted on the manual operation tool 102 formed of a polygonal (hexagonal) bar. The support shaft body 140 is fixed on the manual operation tool 102 with screws 144. Also, the support shaft body 140 has a return sprint 141 in the upper part. In the lower part of the support shaft body 140, the left and right pair of turn sensors 109 are attached.

The return spring 141 is configured as follows: a coil part thereof is located inside the support shaft body 140; both ends of the coil part are protruded radially outward from grooves 140*a* of the support shaft body 140; the grip main body 105 engages with both of the protruded ends; and by turning the grip main body 105 in one direction, one end of the return spring 141 is moved within a corresponding one of the grooves 140*a* of the support shaft body 140. By making the end part of the return spring 141 movable within the predetermined range, a turning angle by which the grip main body 105 is turned is set. The grip main body 105 is restored from a turned position to the original position by the restoring force of the return spring 141.

The grip main body 105 has, in the lower part thereof, actuation pieces 142 each of which is alternatively brought into contact with a corresponding one of the left and right turn sensors 109. By turning the grip main body 105, one of the actuation pieces 142 actuates a corresponding one of the left and right turn sensors 109 to detect a turning direction.

The screws 144 are hidden by a lid 145 provided on the grip main body 105. By removing the lid 145 to attach the screws 144, the grip main body 105 can be attached together with the support shaft body 140 to the manual operation tool 102. By removing the lid 145 to detach the screws 144, the grip main body 105 can be detached together with the support shaft body 140 from the manual operation tool 102.

The grip main body 105 has a spherical head, elliptical body, enlarged bottom shape as an overall shape. Specifically, in the grip main body 105, the head part 105*c* having the top 160 has a roughly spherical shape. The body part 105*d* has a cross-sectionally substantially elliptical shape having a smaller diameter than the head part 105*c* (a circular shape or an oval shape is also possible). Also, the grip main body 105 has a shape making it possible for the thenar eminence to come into contact with a tilted surface 161 in a state where the body part 105*d* is gripped by the palm and middle finger. Further, the grip main body 105 has a shape making it possible to place the thumb and the index finger around the head part 105*c*. The grip main body 105 has, in the lower part thereof, a cross-sectionally substantially circular enlarged tubular part 105*e* having a larger diameter than the body part 105*d*.

The switch 106 at the top 160 is in a location reachable by the tip of the thumb, and the push button 107 is in a location reachable by the tip of a finger.

Although an appropriate position to grip the grip main body 105 depends on the size of an operator's hand, typically, the appropriate position is a position making it possible to place the ball of the thumb on the tip side of the first joint on the switch 106. Also, in the case of gripping the grip main body 105, in a state where the palm is put on the body part 105*d*, the thumb and the finger are placed around the grip main body 105 while forming a ring. The upper part of the palm and the base of the index finger are in a state of covering the head part 105*c*. The lower side of the thenar eminence is in contact with the tilted surface 161, and the wrist overlaps with the enlarged tubular part 105*e*.

The grip main body 105 has a shape based on ergonomics, which when the grip main body 105 is gripped in the appropriate position, makes it easiest to grip the grip main body 105, and provides the best fit like each site of the hand nicely adapts to the grip main body 105.

In the case of frequently performing the up and down action of the blade 126A of the dozer unit 126 with the manual operation tool 102, the manual operation tool 102 may be operated with the hand covering or gripping the head part 105*c* of the grip main body 105, in order to increase a lever ratio to reduce operation force.

The grip main body 105 has, from the body part 105*d* to the head part 105*c*, a thenar eminence reception surface 162 that is brought into contact with the thenar eminence and present on the front side (a surface viewable by an operator); a palm reception surface 163 that is brought into contact with the middle part of the palm and the hypothenar eminence and present on the right lateral surface side; a finger reception surface 164 on the back surface side (on a surface side unviewable by an operator, or on the front surface side in the traveling direction), which is brought into contact with the finger; and an open surface 168 that is located between the tips of the finger and the thenar eminence and can be arranged with the thumb when gripping the grip main body 105, and present on the left lateral surface side.

Figure 13:
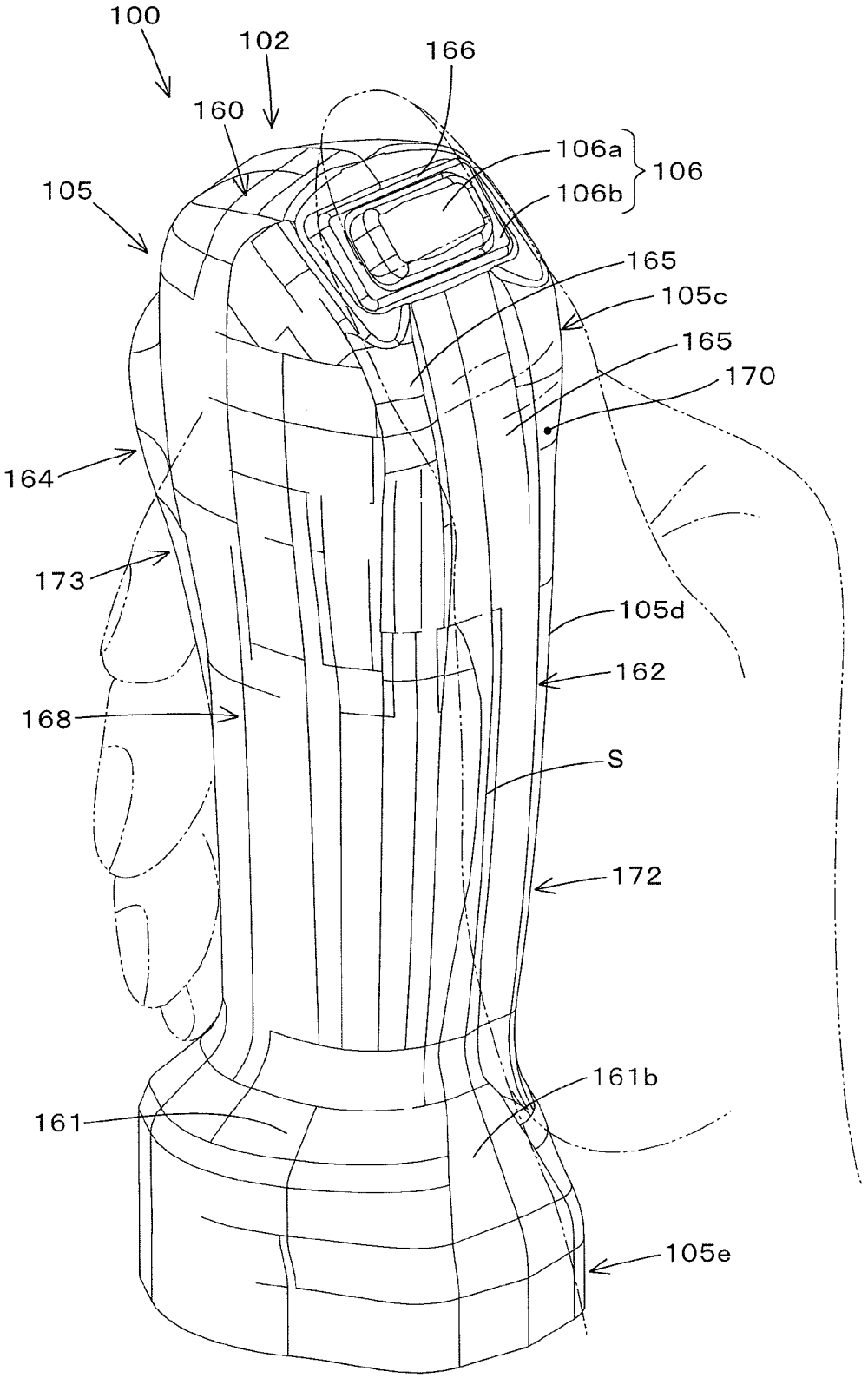
FIG. 13 is a perspective view showing the second embodiment.
Figure 14:
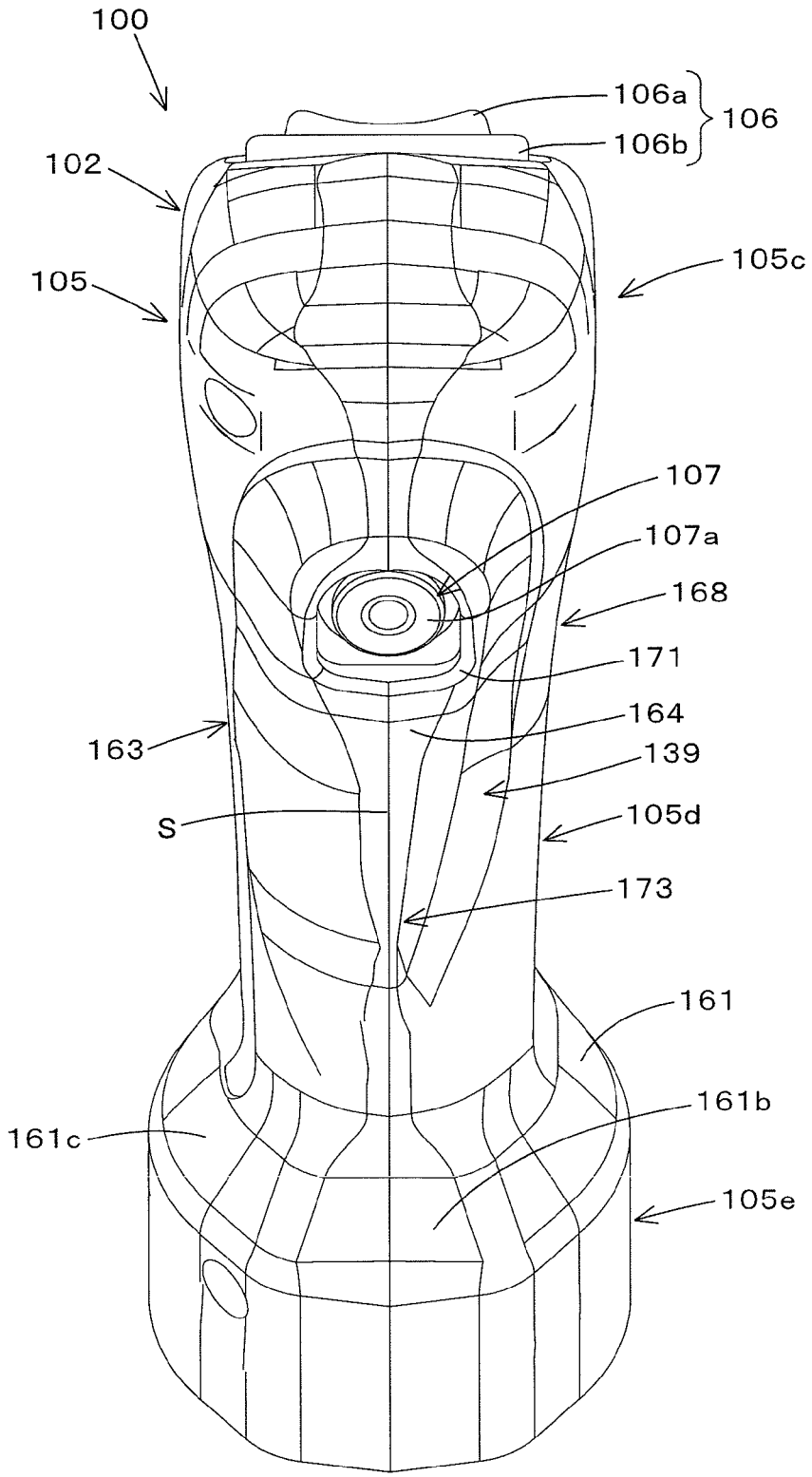
FIG. 14 is a back view showing the second embodiment.
Figure 15:
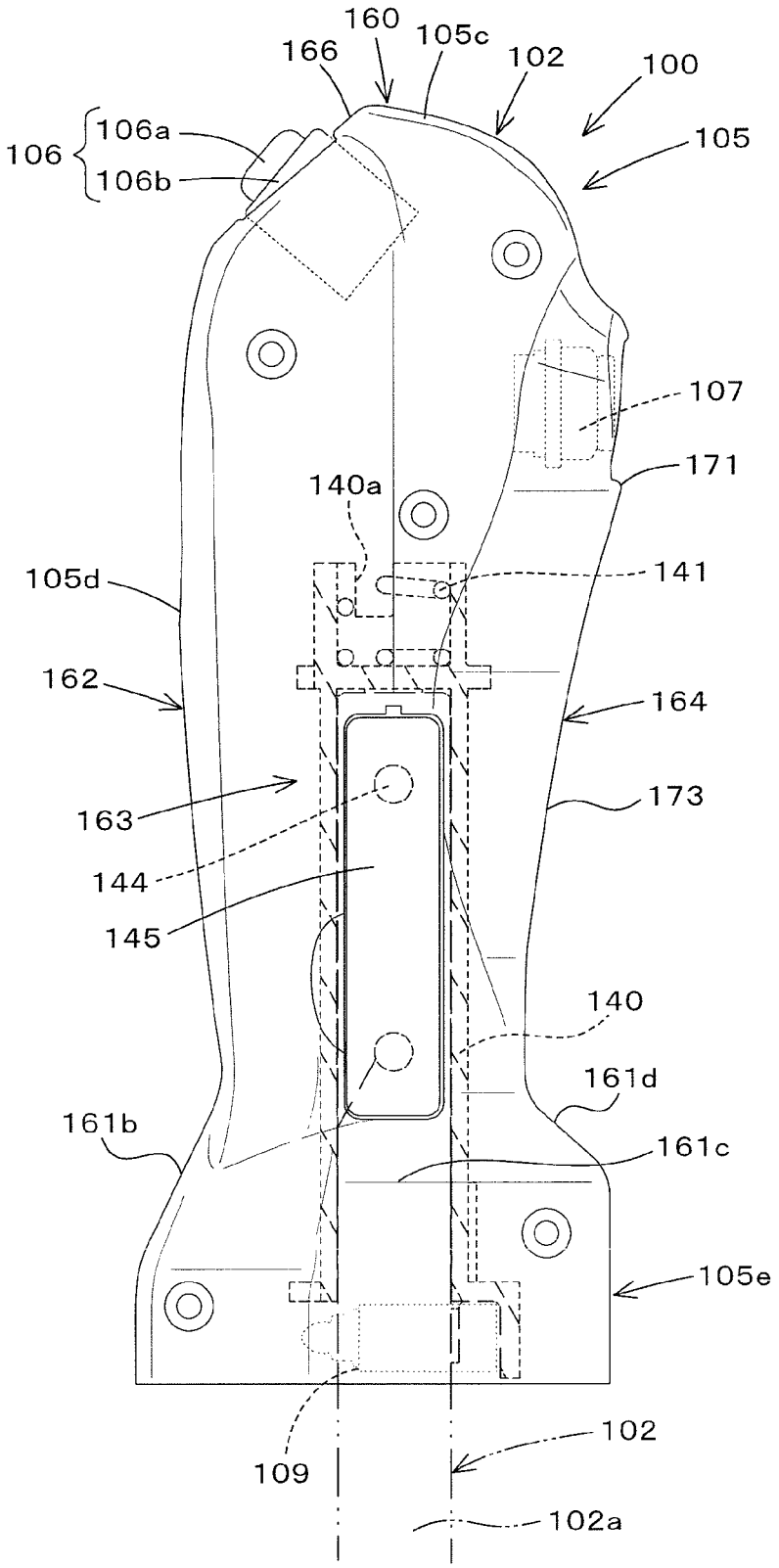
FIG. 15 is a right side view showing a grip.
Figure 16:
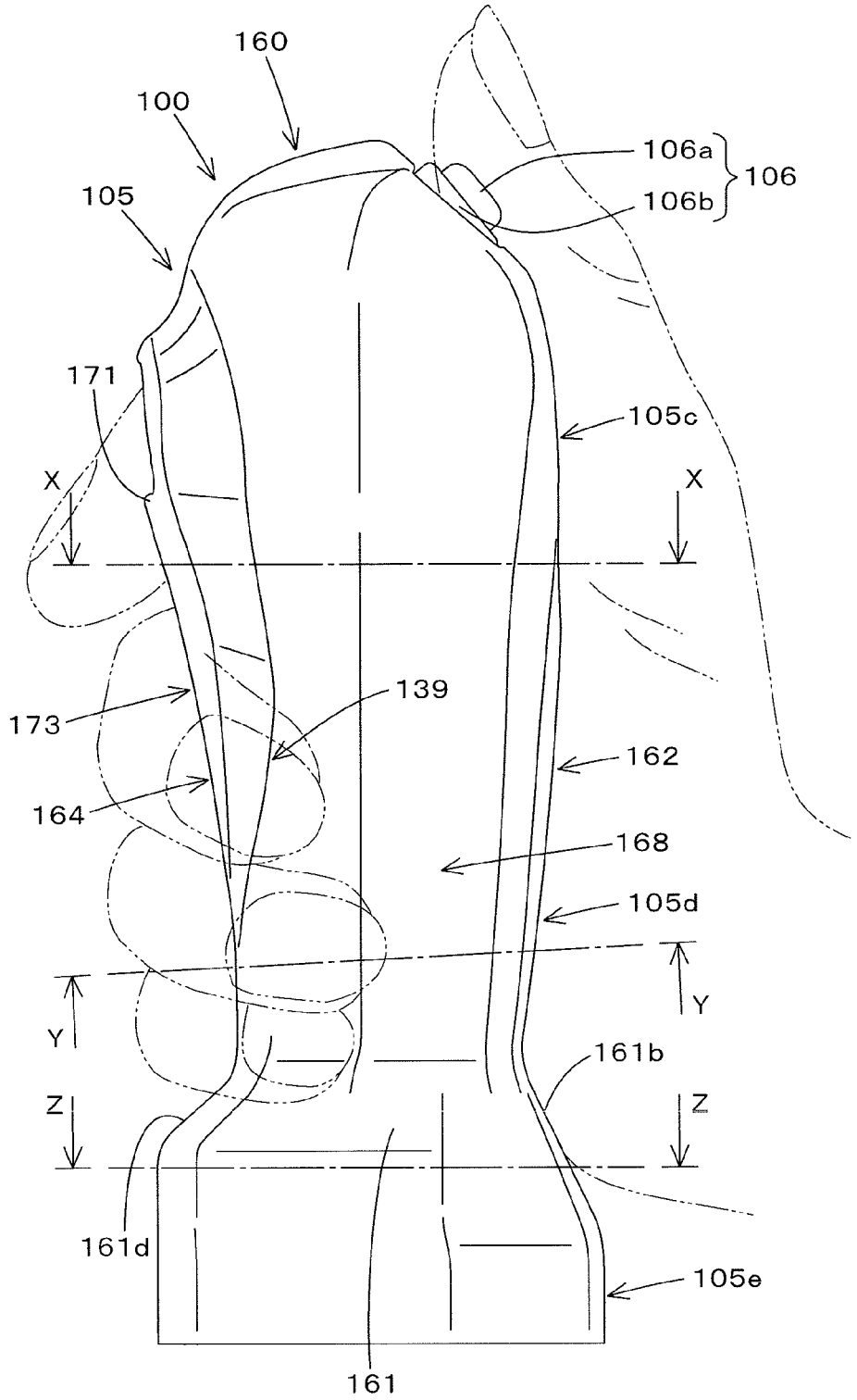
FIG. 16 is a left side view showing the grip.
Figure 17:
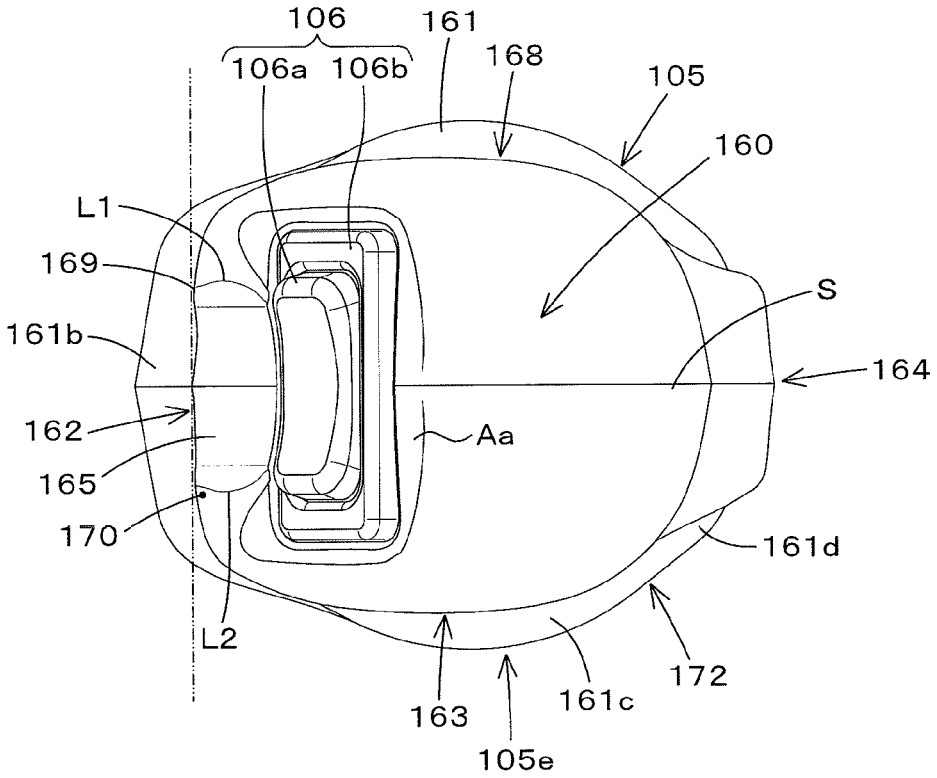
FIG. 17 is a plan view showing the grip.

In the thenar eminence reception surface 162 of the grip main body 105 illustrated in FIGS. 11, 13, and 17, the lower part is brought into contact with the thenar eminence, whereas the upper part is brought into contact with the thumb when operating the switch 106. Of the head part 105*c*, only a part corresponding to the upper part of the thenar eminence reception surface 162 is not spherical but cut out, and thereby from the lower part to the upper part, the thenar eminence reception surface 162 is changed from an arc convex shape to an arc concave shape in the horizontal cross section. This is illustrated in FIG. 17 by comparison with a dashed-two dotted line orthogonal to the centerline S.

The upper part of the thenar eminence reception surface 162 is formed in the arc concave shape. That is, the grip main body 105 is formed with a shallow groove-shaped thumb guiding part 165 along which the ball of the thumb lies. The thumb guiding part 165 is continuous so as to make the bottom of the shallow groove substantially flush with the surface of a pivotally supporting part of an operation body 106*a* of the seesaw switch 106.

The upper part of the thenar eminence reception surface 162 has the shallow groove of the arc concave shape. As a result, the first and second joints of the thumb can come into contact with the upper part over a wide range, and the ball of the thumb can reach the operation body 106*a* of the switch 106 without feeling unevenness in the longitudinal direction.

A flat surface 166 formed at the top 160 of the grip main body 105 surrounds the switch 106. The flat surface 166 enables a reliable operation of the operation body 106*a*. Also, a switch case 106*b* is arranged in a backward tilting state such that the upper part of the surface (upper surface) of the switch case 106*b* is appreciably protruded from the flat surface 166 as compared with the lower part. Accordingly, the thumb arranged on the thumb guiding part 165 can smoothly reach the surface of the operation body 106*a*.

An area around the flat surface 166 at the top 16 of the grip main body 105 is formed as a substantially spherical surface 167. The surface of the switch case 106*b* of the switch 106 is arranged within the substantially spherical surface 167.

Between the thumb guiding part 165 and the open surface 168 and between the thumb guiding part 165 and the palm reception surface 163 in the upper part of the thenar eminence reception surface 163, raised parts are formed. The raised parts are adapted to interfere with the hand from easily reaching the switch 106 (crossing over to the switch operation range).

The raised parts include a first raised part 169 between the thumb guiding part 165 and the open surface 168 and a second raised part 170 between the thumb guiding part 165 and the palm reception surface 163.

The first raised part 169 is gradually raised from the lower side toward the upper side within the thenar eminence reception surface 162 to reach the highest point near the lower side of the switch 106. Also, the first raised part 169 has a first ridge line L1 substantially parallel to the centerline S. The first raised part 169 is adapted to, when moving the thumb from the open surface 168 to the thumb guiding part 165, interfere with the thumb. In doing so, in the case of intentionally moving the thumb, an operator is made to recognize a sense of crossing over from the open surface 168 to the thumb guiding part 165. Also, even in the case of an unintentional operation, an operator is made to recognize a sense of reaching the thumb guiding part 165 from the open surface 168, and thereby careless reaching can be prevented.

The second raised part 170 is gradually raised from the lower side toward the upper side within the thenar eminence reception surface 162 to reach the highest point near the lower side of the switch 106. Also, the second raised part 170 has a second ridge line L2 symmetrical to the first ridge line L1 with respect to the centerline S. In the case of gripping the grip main body 105 by the hand so as to cover the top A of the grip main body 105, the upper part of the thenar eminence or a part between the thenar eminence and the index finger may cover the switch 106, and the second raised part 170 makes an operator recognize that such a part covers the switch 106. Also, the second raised part 170 interferes with the part from pressing the switch 106 to alert the operator.

The first ridge line L1 on the open surface 168 side and the second ridge line L2 on the palm reception surface 163 side are formed so as to each move laterally outward to increase an interval therebetween from the lower part to the upper part.

Figure 12:
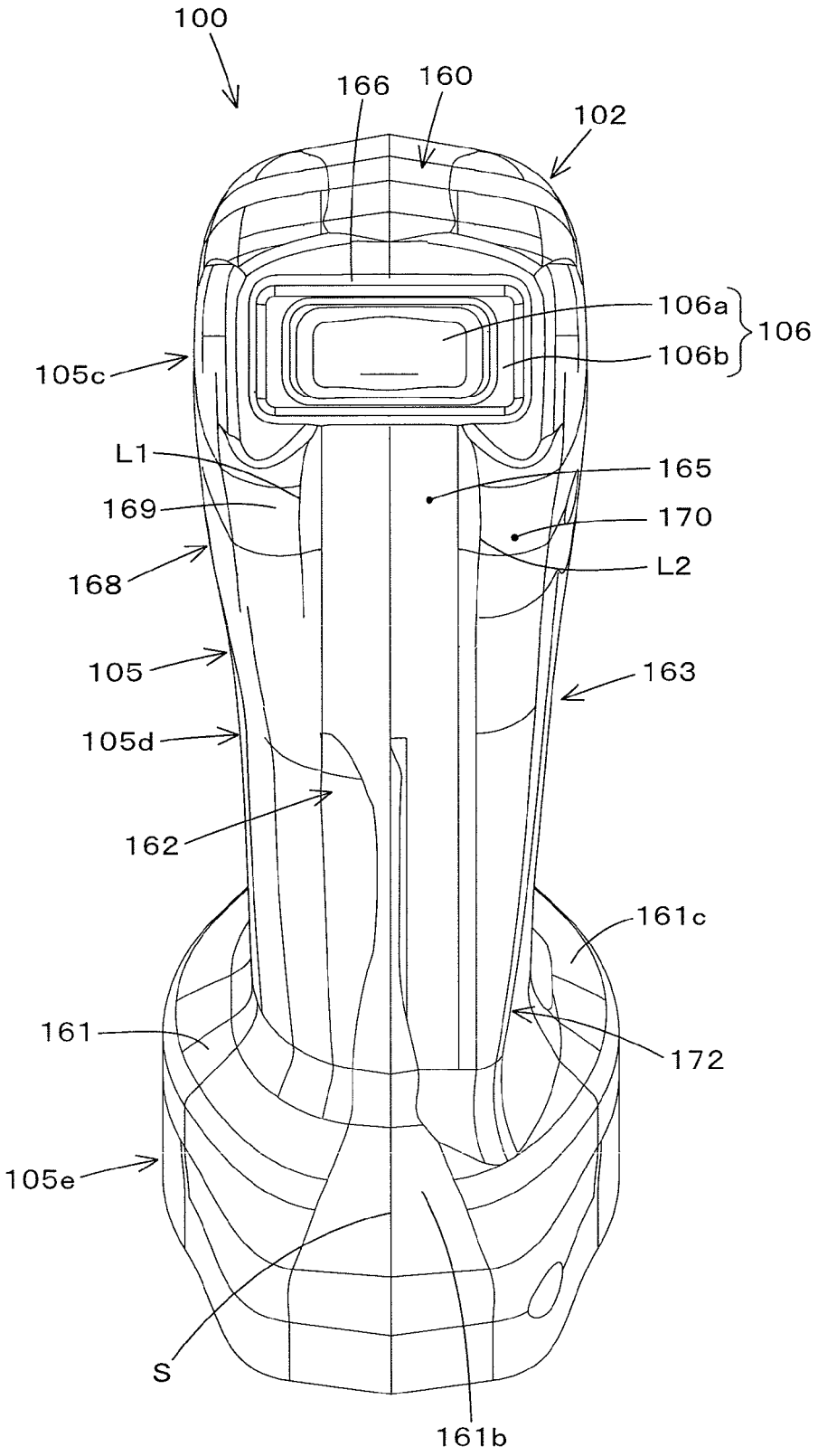
FIG. 12 is a front view seen from an operator, illustrating a second embodiment of the present invention.
Figure 18:
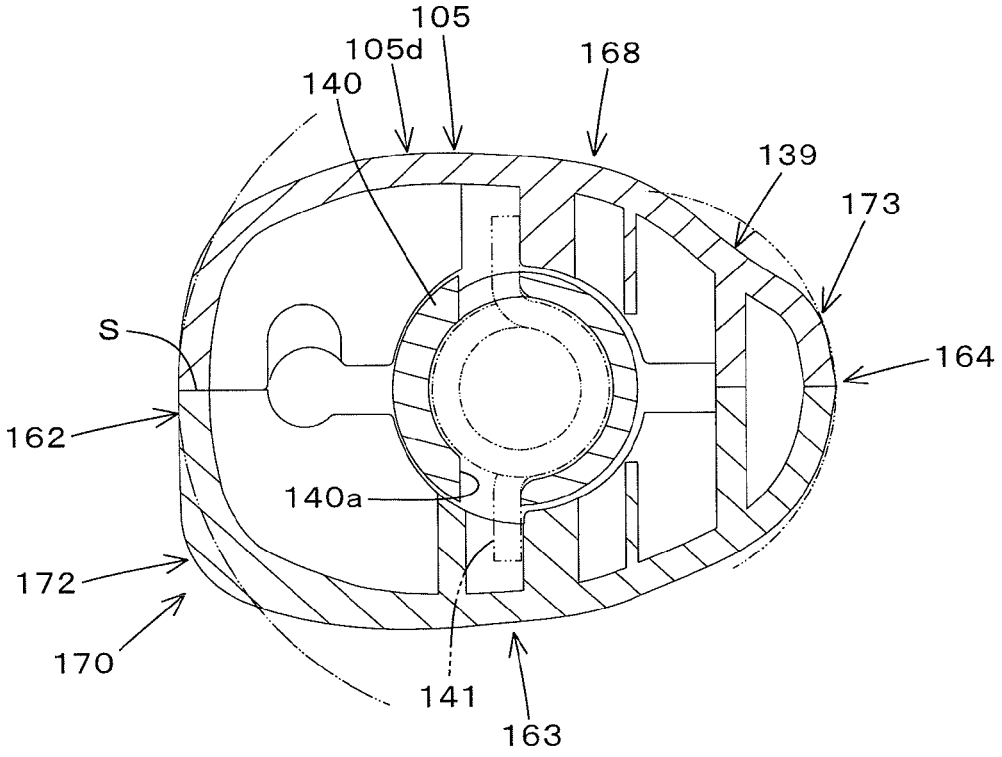
FIG. 18 is a cross-sectional view along the X-X line in FIG. 16.
Figure 19:
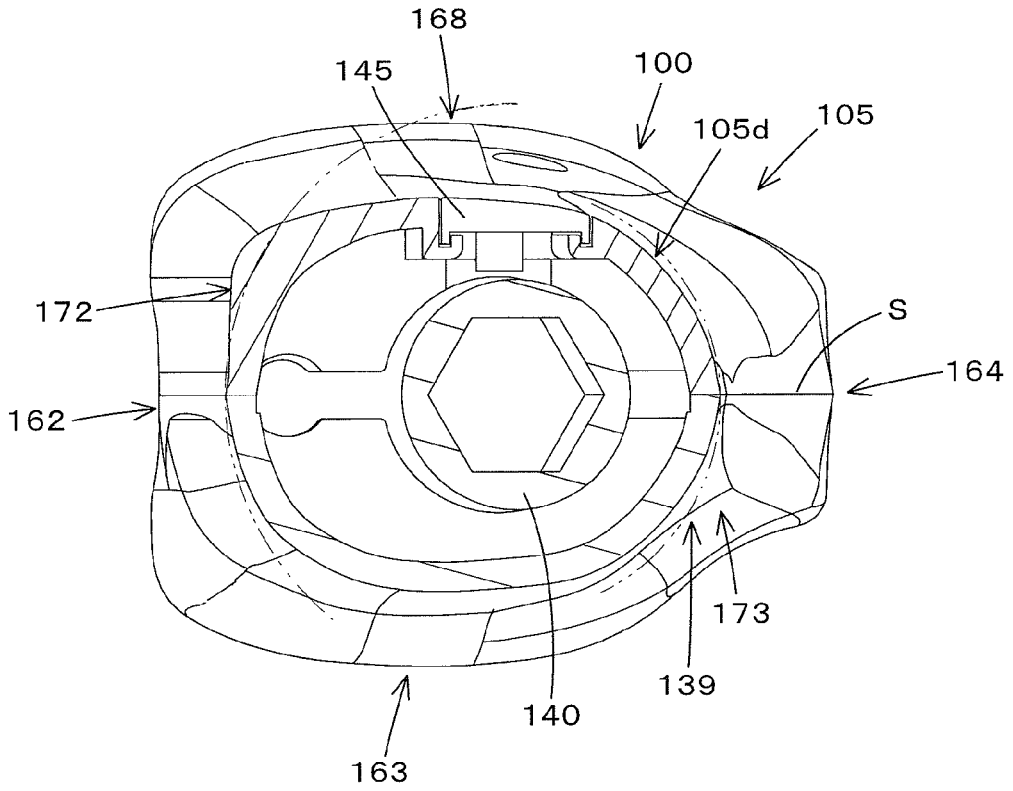
FIG. 19 is a cross-sectional view along the Y-Y line in FIG. 16.
Figure 20:
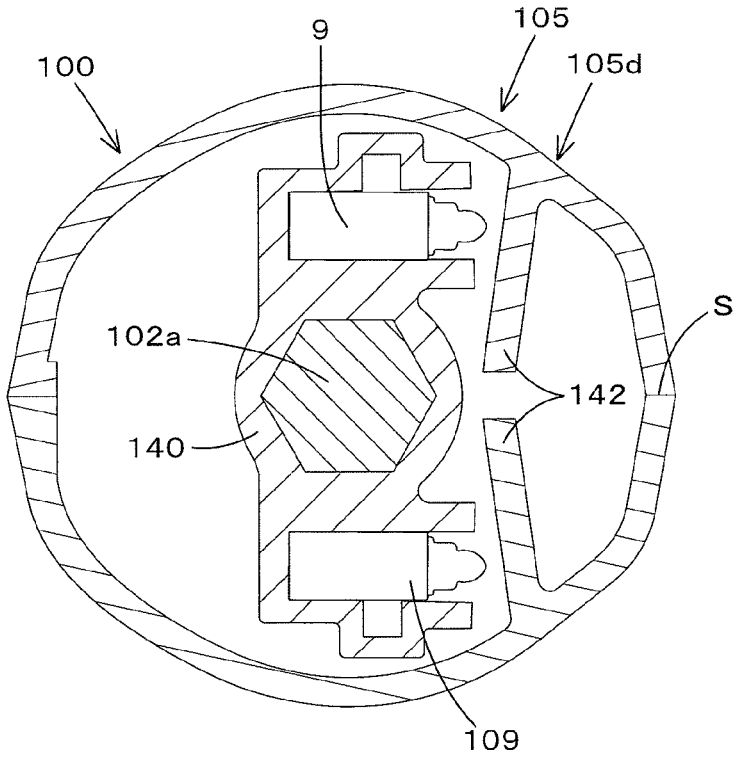
FIG. 20 is a cross-sectional view along the Z-Z line in FIG. 16.
Figure 21:
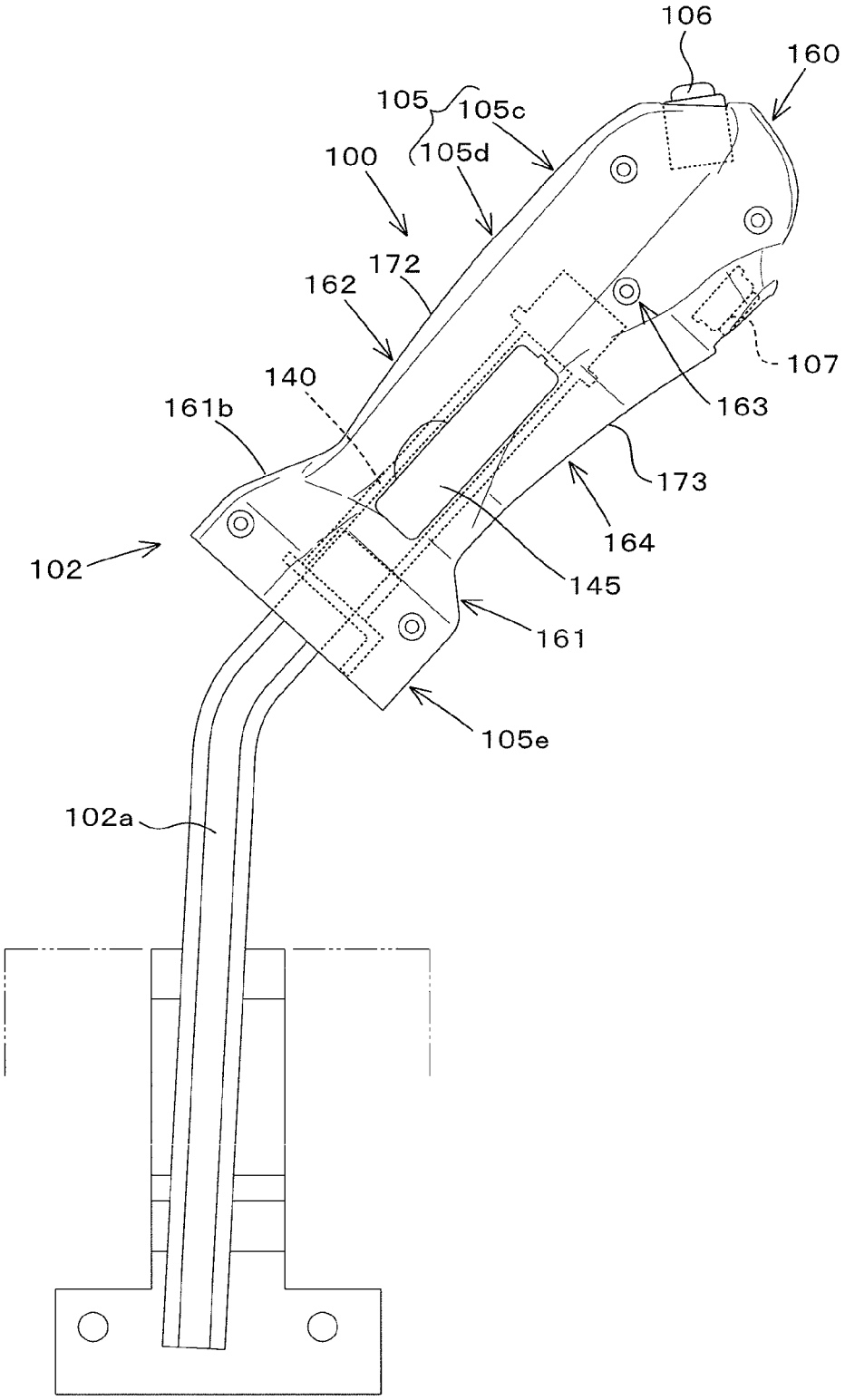
FIG. 21 is a right side showing a state of the attached grip.

Referring to FIGS. 12, 13, and 19, between the thenar eminence reception surface 162 and the palm reception surface 163 in the lower part of the body part 105*d* of the grip main body 105, a palmar flexion pressed part 172 is formed. The palmar flexion pressed part 172 is configured by flattening the lower part of the thenar eminence reception surface 162, and forming a corner part between the thenar eminence reception surface 162 and the palm reception surface 163 as a spherical surface having a small radius. In other words, the palmar flexion pressed part 172 is a part that is formed in a protruded shape by making a distance from the central axis of the grip main body 105 to the corner part larger than a distance from the central axis to the thenar eminence reception surface 162 or the palm reception surface 163. As illustrated in FIG. 18, a dashed-two dotted circle around the shaft center of the support shaft body 140 indicates an outline in the case of not forming the palmar flexion pressed part 172.

When flexing the wrist toward the palmar side (flexing the hand toward the palmar side), the thenar eminence (in particular, the outer right side of the thenar eminence) can come into contact with the palmar flexion pressed part 172 to press the palmar flexion pressed part 172. As a result, the palmar flexion pressed part 172 makes it possible to transmit turning force based on the palmar flexion to the grip main body 105.

The palmar flexion pressed part 172 is integrally connected to the second raised part 170 between the thumb guiding part 165 and the palm reception surface 163 substantially linearly in the vertical direction. Accordingly, the lower part of the second raised part 170 also constitutes the palmar flexion pressed part brought into contact with the thenar eminence. In particular, when gripping the upper part of the grip main body 105, the second raised part 170 acts as the palmar flexion pressed part, and thereby the turning force based on the palmar flexion can be transmitted from the hand to the grip main body 105.

Referring to FIGS. 13 to 16, 18, and 19, in the finger reception surface 164 of the grip main body 105, the upper part is swelled forward as compared with the lower part. Also, the upper part of the finger reception surface 164 is provided with the push button 107 operated with the index or middle finger. Around the push button in the upper part, a raised protection structure part 171 is formed, and the height of the protection structure part 171 is higher than or substantially equal to the height of a push surface 107*a* of the push button 107.

On the finger reception surface 164, a vertically long dorsiflexion hooking part 173 is formed along the centerline S. The dorsiflexion hooking part 173 is integrally connected to the lower part of the protection structure part 171, and the width thereof is gradually narrowed from the upper part to the lower part.

As is clear from the dashed-two dotted circle illustrated in FIG. 18 as a reference, the dorsiflexion hooking part 173 is formed by forming a vertically long depression area 139 between the finger reception surface 164 and the open surface 168. That is, on the finger reception surface 164 side, a relatively vertically long raised part is formed. When placing the tips of the finger on the depressing area 139, the dorsiflexion hooking part 173 as the raised part hooks the finger, and when flexing the wrist toward the dorsal side (flexing the hand toward the dorsal side) with the finger such as mainly the middle and third fingers hooked, turning force based on the dorsiflexion can be transmitted to the grip main body 105.

The grip main body 105 incorporates the left and right turn sensors 109 in the lower part thereof, and also has the enlarged tubular part 105*e* for protection from rainwater. The outer circumferential surface of the enlarged tubular part 105*e* and the lower parts of the thenar eminence reception surface 162, palm reception surface 163, finger reception surface 164, and open surface 168 of the body part 105*d* are connected to each other through the tilted surface 161.

In the circumferential direction of the enlarged tubular part 105*e*, the tilted surface 161 includes tilted surface, which is relatively steep, from the middle part of the palm reception surface 163 to the middle part of the open surface 168 via the finger reception surface 164. Also, the tilted surface 161 includes a tilted surface, which is relatively gentle, from the middle part of the palm reception surface 163 to the middle part of the open surface 168 via the thenar eminence reception surface 162. In particular, a thenar tilted surface 161*b* on the lower side of the thenar eminence reception surface 162 is formed so as to be smoother and have a gentler, and smaller tilt angle than a front tilted surface 161*d* on the lower side of the finger reception surface 164 and a tilted surface 161*e* on the lower side of the open surface 168.

Also, the thenar tilted surface 161*b* has the gentler and smaller tilt angle, and extends to the vertical middle part of the enlarged tubular part 105*e*. In addition, the vertical width is formed so as to gradually increase from the front tilted surface 161*d* on the lower side of the finger reception surface 164 to the thenar tilted surface 161*b* on the lower surface of the thenar eminence reception surface 162 via a palmar tilted surface 161*c* on the lower side of the palm reception surface 163.

The grip 100 is operated to exhibit actions as follows.

The grip 100 constitutes the grip operation part 103 of the manual operation tool or operation lever 102. The swing operation of the grip 100 in the front-back direction can be performed together with the operation lever with the grip 100 gripped by the right hand, for example. Also, the turning operation is performed on the operation lever by flexing the wrist toward the palmar side (flexing the hand toward the palmar side) or flexing the wrist toward the dorsal side (flexing the hand toward the dorsal side) while gripping the grip 100. Further, the switch 106 is operated with the thumb of the right hand, whereas the push button 107 is operated with a finger of the right hand.

The grip main body 105 has the thenar eminence reception surface 162, palm reception surface 163, finger reception surface 164, and open surface 168. Also, the grip main body 105 has in the lower part the large-diameter enlarged tubular part 105*e* incorporating and protecting the turn sensors 109. The grip main body 105 has the spherical head, elliptical body, enlarged bottom shape. When performing a switch operation, normally, the elliptical body part is gripped by the thumb, palm, and finger forming a ring, and a part of the thenar eminence near the wrist is in contact with the enlarged tubular part 105*e*.

Specifically, in the state where the grip main body 105 is gripped, the thenar eminence is in contact with the thenar eminence reception surface 162, and the middle part of the palm and the hypothenar eminence are in contact with the palm reception surface 163. Also, in the state where the grip main body 105 is gripped, the finger is in contact with the finger reception surface 164, and the thumb, thenar eminence, and tips of the finger is in contact with the open surface 168 in the ring form. As a result, in the state where the grip main body 105 is gripped substantially by the thenar eminence and the third and little fingers of the fingers, the thumb and the index or middle finger can operate the switch 106 and the push button 107, without griping the grip main body 105. That is, the thumb and the index or middle finger are freely movable.

The grip main body 105 is fitted turnably with respect to the manual operation tool 102. The turning operations of the grip main body 105 can be performed by flexing the wrist toward the palmar and dorsal sides. A turn of the grip main body 105 with respect to the manual operation tool 102 is detected by any of the turn sensors 109 incorporated in the enlarged tubular part 105*e*.

In the state where the grip main body 105 is gripped by the thenar eminence, and third and little fingers of the fingers of the right hand, the part of the thenar eminence near the wrist contacts with or separates from the enlarged tubular part 105*e* when the swing operation of the operation lever is performed back and forth. On the other hand, between the outer circumferential surface of the enlarged tubular part 105*e* and the lower part of the thenar eminence reception surface 162, the tilted surface 161 is formed, and the thenar tilted surface 161*b* on the lower side of the thenar eminence reception surface 162 is formed so as to have the gentler and smaller tilt angle than a tilt angle of the front tilted surface 161*d* on the lower side of the finger reception surface 164. Accordingly, even in the case where the part of the thenar eminence near the wrist comes into contact with the thenar tilted surface, an operator does not feel strange, but can easily perform the swing operation of the operation lever back and forth without hesitation.

Also, the grip main body 105 includes the palmar flexion pressed part 172. For this reason, when flexing the right wrist toward the palmar side, the thenar eminence presses the palmar flexion pressed part 172 to transmit the turning force based on the palmar flexion to the grip main body 105. On the other hand, the dorsiflexion hooking part 173 on the finger reception surface 164 of the grip main body 105 can hook the finger. Accordingly, when flexing the right wrist toward the dorsal side, the finger can transmit the turning force based on the dorsiflexion to the grip main body 105 through the dorsiflexion hooking part 173.

Note that it is best to configure the shapes of the respective members, and front-back, lateral, and vertical positional relationships among the members in the second embodiment of the present invention as those illustrated in FIGS. 12 to 24. However, the shapes and positional relationships are not limited to those in the second embodiment, and the members and configurations can also be variously modified or differently combined.

For example, in addition to the operation lever for the dozer of the backhoe, the grip 100 may be applied to operation levers of other construction and earth-moving machines such as a tractor, or may be formed for left hand use by being formed in a laterally symmetrical shape.

Also, the grip 100 may be configured not to include the switch 106 and/or the push button 107, or the switch 106 may be replaced by a push button type.

The grip 100 turnable around the lever rod 102*a* may have a function of making the blade 126*a* of the dozer unit 126 perform the tilting action or making the backhoe 121 perform the gear shifting action of switching the travel speed of the backhoe 121.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The texts of Japanese application Nos. 2013-151960, 2013-151961, 2013-151962, 2013-151963, and 2013-151964 filed on Jul. 22, 2013 are hereby incorporated by reference.

The invention claimed is:

1. An operation lever for operation of a blade of a dozer unit disposed on a construction machine, the blade being operated in an up and down action, in an angle action and in a tilting action, the angle action moving the blade to differentiate back and forth positions of longitudinal ends of the blade, the tilting action moving the blade to differentiate vertical positions of longitudinal ends of the blade, comprising:

a lever shaft including: an upper part extending upward, the upper part being located above a center portion of the lever shaft relative to a longitudinal direction of the lever shaft, the lever shaft being configured to be operable back and forth, corresponding to the up and down action of the blade; and a grip provided on the upper part of the lever shaft, the grip including:

a grip core member attached to the lever shaft, the grip core member including:

a first stopper and a second stopper; and a grip main body configured to be rotated about a shaft center of the lever shaft and being supported by the grip core member, thereby being capable of rotating in a clockwise direction and in a counterclockwise direction from a neutral position by a predetermined rotation angle, such that rotation of the grip main body is configured to cause movement of the blade in the angle action and in the tilting action, wherein the first stopper is configured to restrict the rotation of the grip main body in the counterclockwise direction from the neutral position by a first predetermined rotation angle, and the second stopper is configured to restrict the rotation of the grip main body in the clockwise direction from the neutral position by a second predetermined rotation angle, and wherein the second predetermined rotation angle is different from the first predetermined rotation angle.

2. The operation lever according to claim 1, wherein the grip includes:

a return-to-neutral spring configured to return the grip main body from a rotated position to the neutral position;

a first rotation detection sensor configured to detect rotation of the grip main body in the first predetermined rotation angle; and a second rotation detection sensor configured to detect rotation of the grip main body in the second predetermined rotation angle.

3. The operation lever according to claim 2, wherein the grip core member includes:

a first sensor attachment part configured to attach the first rotation detection sensor thereon, the first sensor attachment part having the first stopper; and a second sensor attachment part configured to attach the second rotation detection sensor thereon, the second sensor attachment part having the second stopper.

4. The operation lever according to claim 3, wherein the grip main body includes:

a first contact wall configured to contact the first stopper during rotation of the grip main body in the first predetermined rotation angle; and a second contact wall configured to contact the second stopper during rotation of the grip main body in the second rotation angle.

5. The operation lever according to claim 1 or 2, wherein the grip main body includes:

a first contact wall configured to contact the first stopper during rotation of the grip main body in the first predetermined rotation angle; and a second contact wall configured to contact the second stopper during rotation of the grip main body in the second rotation angle.

6. An operation lever comprising:

a lever shaft having a fit part formed in a polygonal bar shape; and a grip provided on an upper part of the lever shaft, the grip including:

a grip core member externally fitting to the fit part of the lever shaft, the grip core member including a fit hole having a surface to be contacted with the fit part of the lever shaft and being screwed to the lever shaft in a state where the fit hole of the grip core member externally fits to the fit part of the lever shaft; and a grip main body supported by the grip core member, the grip main body being capable of rotating around a shaft center of the lever shaft by a predetermined angle, wherein the grip core member being arranged inside the grip main body, the grip main body including:

an attachment opening for allowing the grip core member to be screwed to the lever shaft, and a detachable cover for covering the attachment opening.

7. The operation lever according to claim 6, wherein the lever shaft is a hexagonal bar, and the fit hole is a hexagonal hole having a cross-sectional shape corresponding to a cross-sectional shape of the lever shaft.

8. The operation lever according to claim 6, wherein the grip core member includes a spring containing part adapted to contain a return-to-neutral spring to return the grip main body to a neutral position from a position to which the grip main body is rotationally operated and a sensor attachment part to which a rotation detection sensor adapted to detect a rotation of the grip main body is attached.

9. An operation lever comprising:

a lever shaft having a fit part formed in a polygonal bar shape; and a grip provided on an upper part of the lever shaft, the grip including:

a grip core member externally fitting to the fit part of the lever shaft, the grip core member including a fit hole having a surface contacting the fit part of the lever shaft and being screwed to the lever shaft in a state where the fit hole of the grip core member externally fits to the fit part of the lever shaft; and a grip main body supported by the grip core member, the grip main body being capable of rotating around a shaft center of the lever shaft by a predetermined angle, wherein the grip core member includes a spring containing part adapted to contain a return-to-neutral spring to return the grip main body to a neutral position from a position to which the grip main body is rotationally operated, and a sensor attachment part to which a rotation detection sensor adapted to detect a rotation of the grip main body is attached.

10. The operation lever according to claim 9, wherein the lever shaft is a hexagonal bar, and the fit hole is a hexagonal hole having a cross-sectional shape corresponding to a cross-sectional shape of the lever shaft.

* * * * *